US008431301B2

(12) United States Patent
Ninomiya et al.

(10) Patent No.: US 8,431,301 B2
(45) Date of Patent: Apr. 30, 2013

(54) TONER FOR DEVELOPING ELECTROSTATIC CHARGE IMAGE, ELECTROSTATIC CHARGE IMAGE DEVELOPER, TONER CARTRIDGE, PROCESS CARTRIDGE, AND IMAGE FORMING APPARATUS

(75) Inventors: Masanobu Ninomiya, Kanagawa (JP); Kiyohiro Yamanaka, Kanagawa (JP); Hirokazu Hamano, Kanagawa (JP); Eisuke Iwazaki, Kanagawa (JP); Hiroshi Nakazawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 928 days.

(21) Appl. No.: 12/243,446

(22) Filed: Oct. 1, 2008

(65) Prior Publication Data

US 2009/0233210 A1 Sep. 17, 2009

(30) Foreign Application Priority Data

Mar. 17, 2008 (JP) ..... 2008-068328

(51) Int. Cl.
*G03G 9/08* (2006.01)
*G03G 9/087* (2006.01)

(52) U.S. Cl.
USPC ..... 430/109.4; 430/110.3; 430/110.4

(58) Field of Classification Search ..... 430/110.1, 430/110.3, 110.4, 109.4
See application file for complete search history.

(56) References Cited

U.S. PATENT DOCUMENTS

| | | | | |
|---|---|---|---|---|
| 5,346,797 | A | 9/1994 | Kmiecik-Lawrynowicz et al. | |
| 6,416,917 | B1 * | 7/2002 | Nakanishi et al. | 430/109.2 |
| 2001/0031414 | A1 * | 10/2001 | Yoshida et al. | 430/108.3 |
| 2004/0229147 | A1 * | 11/2004 | Higuchi et al. | 430/110.3 |
| 2007/0141498 | A1 * | 6/2007 | Umehara | 430/108.21 |
| 2008/0025754 | A1 | 1/2008 | Ishiyama et al. | |
| 2008/0057430 | A1 * | 3/2008 | Takahashi et al. | 430/109.4 |
| 2008/0124636 | A1 * | 5/2008 | Yamaguchi et al. | 430/48 |
| 2008/0268366 | A1 | 10/2008 | Nakayama et al. | |
| 2009/0011356 | A1 | 1/2009 | Tomita et al. | |

FOREIGN PATENT DOCUMENTS

| | | |
|---|---|---|
| CN | 1853143 A | 10/2006 |
| JP | A-63-282752 | 11/1988 |

(Continued)

OTHER PUBLICATIONS

Jul. 19, 2011 Office Action issued in Chinese patent application No. 200810179544.3 (with translation).

(Continued)

*Primary Examiner* — Jonathan Jelsma
(74) *Attorney, Agent, or Firm* — Oliff & Berridge, PLC

(57) ABSTRACT

There is provided a toner for developing an electrostatic charge image including a binder resin, a colorant and a releasing agent, wherein the content ratio of particles having a number particle diameter of 4.5 μm or more and less than 7.5 μm and a circularity degree of 0.980 or more is in a range from about 5 number % to about 15 number %, and the content ratio of particles having a number particle diameter of not 7.5 μm or more and less than 15 μm and a circularity degree of 0.900 or more and less than 0.940 is about 5 number % or less.

18 Claims, 2 Drawing Sheets

FOREIGN PATENT DOCUMENTS

| | | |
|---|---|---|
| JP | A-6-250439 | 9/1994 |
| JP | A-09-106093 | 4/1997 |
| JP | A-11-344829 | 12/1999 |
| JP | A-2000-267331 | 9/2000 |
| JP | A-2001-34008 | 2/2001 |
| JP | A-2004-151709 | 5/2004 |
| JP | A-2004-198752 | 7/2004 |
| JP | A-2004-271586 | 9/2004 |
| JP | A-2005-189755 | 7/2005 |
| JP | A-2005-208630 | 8/2005 |
| JP | A-2005-308891 | 11/2005 |
| JP | A-2006-171214 | 6/2006 |
| JP | A-2007-57764 | 3/2007 |
| JP | A-2007-121473 | 5/2007 |
| JP | A-2007-256432 | 10/2007 |
| JP | A-2007-279653 | 10/2007 |
| KR | 10-2008-0011043 A | 1/2008 |

OTHER PUBLICATIONS

May 29, 2012 Office Action issued in Japanese Patent Application No. 2008-068328 (with translation).

Jun. 25, 2012 Office Action issued in Korean Patent Application No. 10-2008-0121859 (with English translation).

* cited by examiner

TONER FOR DEVELOPING ELECTROSTATIC CHARGE IMAGE, ELECTROSTATIC CHARGE IMAGE DEVELOPER, TONER CARTRIDGE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2008-068328 filed Mar. 17, 2008.

BACKGROUND

The present invention relates to a toner for developing an electrostatic charge image, an electrostatic charge image developer, a toner cartridge, a process cartridge and an image forming apparatus.

Related Art

Many methods for electrophotography are known. Generally, a latent image is electrically formed, using various methods, on a surface of a photoreceptor (image holding member) using a photoconductive substance, the formed latent image is developed using a toner for electrostatic charge image development (hereinafter, sometimes referred to as "toner") to form a toner image, then the toner image on the photoreceptor surface is transferred to a surface of a transfer-receiving body such as paper optionally using an intermediate transfer-receiving body, and the transferred image is heated, pressurized, or heated and pressurized, to fix the image, or the transferred image is fixed by solvent evaporation, thereby forming the fixed image. The toner remaining on the photoreceptor surface is cleaned by various methods, if necessary, before being subjected again to the above processes.

As a fixing technique for fixing a transferred image which has been transferred onto the surface of a transfer-receiving body, a heat roll fixing method is generally known, wherein a transfer-receiving body, onto which a toner image has been transferred, is inserted between a pair of rolls including a heating roll and a pressure roll followed by fixing the transferred toner image. Further, as a similar technique, a fixing method in which one or both of the rolls is replaced with a belt is also known. In these techniques, as compared with other fixing methods, a durable fixed image is obtained quickly, and energy efficiency is high, and moreover, there is less damage to the environment by volatilization of a solvent or the like.

SUMMARY

According to an aspect of the invention, there is provided a toner for developing an electrostatic charge image including a binder resin, a colorant and a releasing agent, wherein a content ratio of particles having a number particle diameter of 4.5 μm or more and less than 7.5 μm and a circularity degree of 0.980 or more is in a range of from about 5 number % to about 15 number %, and a content ratio of particles having a number particle diameter of 7.5 μm or more and less than 15 μm and a circularity degree of 0.900 or more and less than 0.940 is about 5 number % or less.

BRIEF DESCRIPTION OF THE DRAWINGS

Exemplary embodiment(s) of the present invention will be described in detail based on the following figures, wherein.

DETAILED DESCRIPTION

Figure 1:
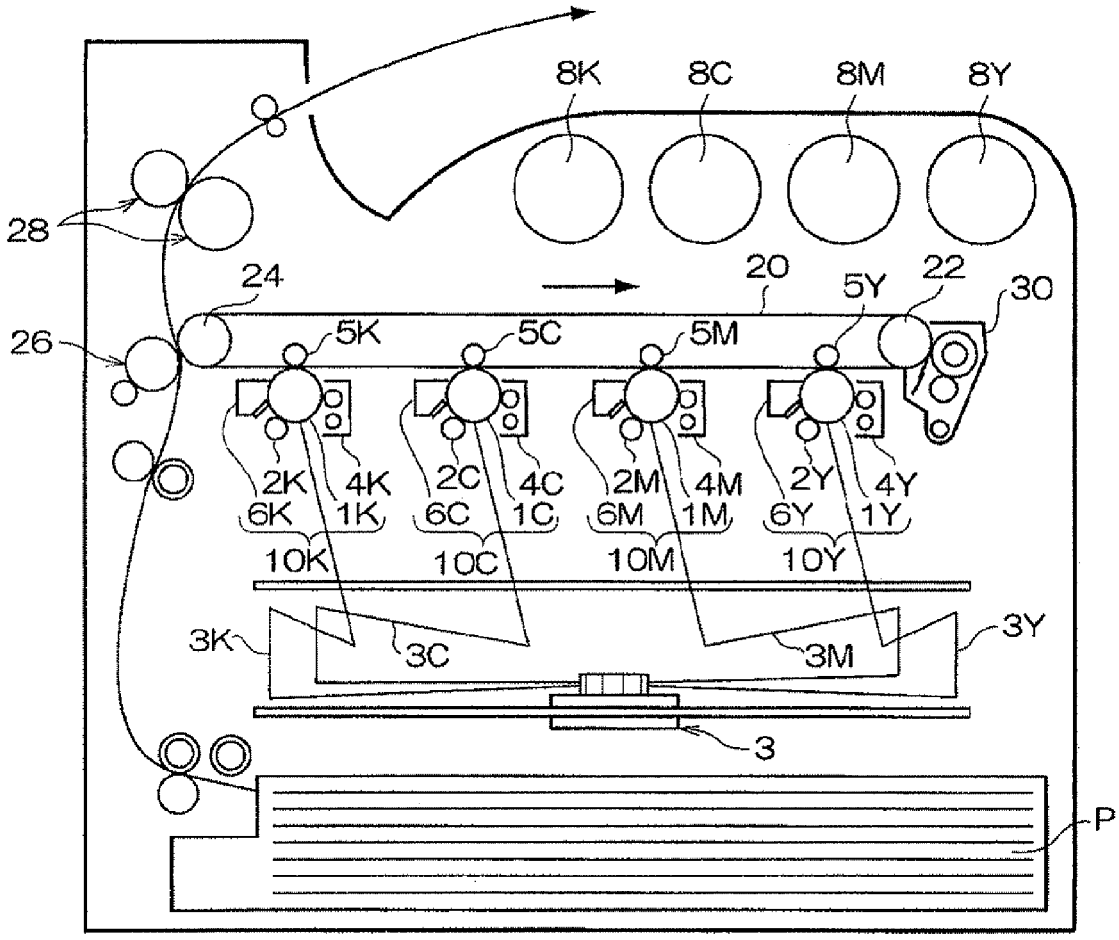
FIG. 1 is a schematic constitutional diagram which illustrates one example of an image forming apparatus of an exemplary embodiment.

The invention was made in view of the above-mentioned circumstances. It is an object of the present invention to provide a toner for developing an electrostatic charge image by which tone reproducibility and density uniformity are improved and generation of stain inside an apparatus is controlled even when image formation is performed by a high-speed process under a high-temperature and high-humidity environment, and to provide a developer for developing an electrostatic charge image, a toner cartridge, a process cartridge, and an image forming apparatus using the toner.

The problems mentioned above has been solved by the invention shown below.

Namely, according to a first aspect of the invention is provided a toner for developing an electrostatic charge image comprising a binder resin, a colorant and a releasing agent, wherein a content ratio of particles having a number particle diameter of 4.5 μm or more and less than 7.5 μm and a circularity degree of 0.980 or more is from 5 number % to 15 number %, and a content ratio of particles having a number particle diameter of 7.5 μm or more and less than 15 μm and a circularity degree of 0.900 or more and less than 0.940 is 5 number % or less.

According to a second aspect of the invention is provided the toner for developing an electrostatic charge image of the first aspect, wherein the binder resin contains a crystalline polyester resin.

According to a third aspect of the invention is provided the toner for developing an electrostatic charge image of the second aspect, wherein an acid-derived component of the crystalline polyester resin contains an aliphatic dicarboxylic acid.

According to a fourth aspect of the invention is provided the toner for developing an electrostatic charge image of the third aspect, wherein the aliphatic dicarboxylic acid is a straight-chain carboxylic acid.

According to a fifth aspect of the invention is provided the toner for developing an electrostatic charge image of the second aspect, wherein an alcohol-derived component of the crystalline polyester resin comprises an aliphatic diol-derived constituent component, and a content of the aliphatic diol-derived constituent component in the alcohol-derived component included in the crystalline polyester resin is 80% by constituent mole or more.

According to a sixth aspect of the invention is provided the toner for developing an electrostatic charge image of the second aspect, wherein the crystalline polyester resin is an aliphatic crystalline polyester resin.

According to a seventh aspect of the invention is provided the toner for developing an electrostatic charge image of the sixth aspect, wherein a constituent ratio of an aliphatic polymerizable monomer that constitutes the aliphatic crystalline polyester resin is 60 mol % or more.

According to an eighth aspect of the invention is provided the toner for developing an electrostatic charge image of the sixth aspect, wherein the aliphatic crystalline polyester resin is an aliphatic crystalline polyester resin which is obtained by reacting a dicarboxylic acid having 10 to 12 carbon atoms with a diol having 4 to 9 carbon atoms.

According to a ninth aspect of the invention is provided the toner for developing an electrostatic charge image of the second aspect, wherein the crystalline polyester resin has a weight average molecular weight (Mw) of 6,000 to 35,000.

According to a tenth aspect of the invention is provided the toner for developing an electrostatic charge image of the second aspect, wherein the crystalline polyester resin has a melting temperature (Tm) of 60° C. to 120° C.

According to an eleventh aspect of the invention is provided the toner for developing an electrostatic charge image of the second aspect, wherein a content of the crystalline polyester resin in the toner is from 1% by weight to 40% by weight.

According to a twelfth aspect of the invention is provided the toner for developing an electrostatic charge image of the first aspect, wherein the binder resin contains a non-crystalline polyester resin which contains a resin of a high molecular weight component and a resin of a low molecular weight component.

According to a thirteenth aspect of the invention is provided the toner for developing an electrostatic charge image of the twelfth aspect, wherein the resin of the high molecular weight component has a weight average molecular weight Mw of 30,000 to 200,000.

According to the fourteenth aspect of the invention is provided the toner for developing an electrostatic charge image of the twelfth aspect, wherein the resin of the low molecular weight component has a weight average molecular weight Mw of 8,000 to 25,000.

According to a fifteenth aspect of the invention is provided the toner for developing an electrostatic charge image of the twelfth aspect, in which a mixing ratio P/Q is 10/90 to 70/30 where the weight of the high molecular weight component is indicated by P and the weight of the low molecular weight component is indicated by Q.

According to a sixteenth aspect of the invention is provided an electrostatic charge image developer comprising a toner, wherein the toner is the toner for developing an electrostatic charge image of the first aspect.

According to a seventeenth aspect of the invention is provided a toner cartridge in which at least a toner is contained, wherein the toner is the toner for developing an electrostatic charge image of the first aspect.

According to the eighteenth aspect of the invention is provide a process cartridge which comprises at least a developer holding member and the electrostatic charge image developer of the sixteenth aspect.

According to a nineteenth aspect of the invention is provided an image forming apparatus comprising an image holding member, a developing unit that develops an electrostatic charge image formed on the image holding member into a developed image by a developer, a transfer unit that transfers the developed image formed on the image holding member to a transfer-receiving body, and a fixing unit that fixes the transferred image transferred to the transfer-receiving body, wherein the developer is the electrostatic charge image developer of the sixteenth aspect.

The present invention is described in more detail below by referring to exemplary embodiments.

<Toner for Developing Electrostatic Charge Image>

A toner for developing an electrostatic charge image of an exemplary embodiment of the invention is characterized in that it contains a binder resin, a colorant and a releasing agent, wherein a content ratio of particles having a number particle diameter of 4.5 μm or more and less than 7.5 μm and a circularity degree of 0.980 or more is in a range from equal to or about 5 number % to equal to or about 15 number %, and a content ratio of particles having a number particle diameter of 7.5 μm or more and less than 15 μm and a circularity degree of 0.900 or more and less than 0.940 is 5 number % or about 5 number % or less.

For low temperature fixation of a toner, a crystalline polyester resin may be used in the binder resin. However, since the crystalline polyester resin tends to have inherently a lower miscibility with a non-crystalline resin, a phase separated structure is easily formed between the crystalline polyester resin and the non-crystalline polyester resin when both are used in the preparation of a toner, thus resulting in difficulty to obtain a toner having an acceptable evenness (the state where the phase separation is not observed).

For this reason, fluidity of the toner and the like tend to decrease due to the surface unevenness described above and inherent properties of the crystalline polyester resin. In particular, in the case where image formation is performed by an electrophotographical process at a relatively high speed (at a linear velocity of 300 mm/sec or higher) under a high-temperature and high-humidity environment (for example, at 28° C. and 85% RH) where the crystalline polyester resin easily absorbs moisture, the fluid of the toner further decreases as well as an amount of electrostatic charge of the toner decreases, resulting in that faithful image reproducibility including tone reproducibility cannot be secured or stain inside the apparatus may be generated due to toner scattering or the like.

Regarding the problems, it is possible to increase the fluidity by, for example, spheridizing the shape of a toner. It is also possible to increase the fluidity to a certain degree by enlarging the particle diameter of a toner. However, if the shape of toner is made excessively close to spherical, the cleaning property after transfer will deteriorate. Moreover, excessive enlargement of the particle diameter of a toner will cause not only lowering of image quality but also deterioration of charging property, which may cause toner scattering.

In light of such situations, the inventors investigated a shape/particle size region which is optimum for tone reproducibility and for control of stain inside the apparatus by considering both the shape distribution and the particle diameter distribution of the toner in combination without controlling them independently. As a result, they found a region which is most effective for the problems in a number particle diameter-circularity map of a toner (a map showing the relationship between the circularity and the number particle diameter together with each content ratio) by limiting the content ratios of the toners within the specific circularity ranges and number diameter ranges.

The toner of the exemplary embodiment basically contains a crystalline resin. Therefore, its particle diameter can not be reduced by a kneading and pulverization method and it is produced by an emulsification and aggregation method. In this case, if the resin component is made into emulsified particles, crystalline polyester resin particles will aggregate solely first in an aggregation process and the particles are prone to form spheres. Therefore, it is impossible to make precise control with regard to particle diameter distribution and shape distribution.

In the exemplary embodiment, the content ratios of a toner in the regions each specified by the number particle diameter distribution/circularity degree distribution (these ratios are hereinafter be referred to as "particle diameter distribution/circularity degree distribution" in some case) are adjusted to the most effective ranges. Therefore, as described later, a toner of the exemplary embodiment is not obtained until conditions of the emulsification and aggregation method are determined minutely.

The toner of the exemplary embodiment is required, as a first requirement about the particle diameter distribution/circularity degree distribution, that the content ratio of particles having a number particle diameter of 4.5 μm or more and less than 7.5 μm and a circularity degree of 0.980 or more is in a range of from equal to or about 5 number % to equal to or about 15 number %. This requirement unit that particles high in circularity degree (very close to a spherical shape) are needed to exist in a certain ratio as particles in the vicinity of the number average particle diameter of the toner. When this requirement is satisfied, density reproducibility (reduction in density unevenness) and highlight reproducibility (good tone reproducibility) can be attained.

The content ratio of particles whose number particle diameter range is from 5.0 μm to 7.0 μm and whose circularity degree range is 0.980 or more, preferably in a range from 8 number % to 13 number %, and more preferably in a range from 10 number % to 12 number %.

Here, the particle diameter distribution and the circularity degree distribution of the toner are determined by using an FPIA-3000 manufactured by Sysmex.

The FPIA-3000 manufactured by Sysmex is an apparatus adopting a system in which particles dispersed in water are measured by the flow-type image analysis method. A sucked suspension of particles is introduced into a flat sheath flow cell and it is formed into a flat sample flow by unit of a sheath liquid. By applying a strobe light to the sample flow, passing particles are photographed, as still pictures of at least 5,000 toner particles, with a CCD camera through an object lens. The taken particle images are subjected to two-dimensional image processing. An equivalent circular diameter is calculated from a projected area and a perimeter. Regarding the equivalent circular diameter, a diameter of a circle whose area is equal to the area of the two-dimensional image of each photoed particle is calculated as the equivalent circular diameter of the particle.

In the exemplary embodiment, the equivalent circular diameter (number average) is defined as the particle diameter of each toner particle. The circularity degree is calculated according to the following equation (1). Moreover, the content ratio (number %) for each of a certain particle diameter range and a certain circularity degree range can be determined by statistically processing the data of individual toner particles. This is also applied hereafter.

$$\text{circularity degree}=(\text{equivalent circular perimeter})/\text{perimeter}=[2\times(A\times\pi)^{1/2}]/PM \quad \text{Equation (1)}$$

(In the equation, A represents a projected area and PM represents a perimeter.)

Moreover, the toner of the exemplary embodiment is required, as a second requirement about the particle diameter distribution/circularity degree distribution, that the content ratio of particles having a number particle diameter of 7.5 μm or more and less than 15 μm and a circularity degree of 0.900 or more and less than 0.940 is 5 number % or about 5 number % or less. This condition unit that the amount of low-circularity particles (particles having considerable irregularities) in the near upper end of the particle diameter distribution of the toner should be a certain ratio or less. By satisfying this condition, it is possible to control the occurrence of scattering inside the apparatus (toner cloud).

The content ratio of particles whose number particle diameter range is 7.5 μm or more and less than 15 μm and whose circularity degree range is 0.900 or more and less than 0.940 is preferably 3 number % or less, more preferably 1 number % or less, and ideally 0 number %.

Hereafter, the toner of the exemplary embodiment is explained in detail for each constitution.

The toner of the exemplary embodiment is not particularly limited as long as it contains a binder resin, a colorant and a releasing agent and it satisfies the limitations about the content ratios of the specific particles.

(Binder Resin)

Examples of the binder resin includes homopolymers or copolymers of monoolefins such as ethylene, propylene, butylene and isoprene; vinyl esters such as vinyl acetate, vinyl propionate, vinyl benzoate and vinyl butyrate; α-methylene aliphatic monocarboxylic acid esters such as methyl acrylate, phenyl acrylate, octyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. Furthermore, polyester resins, polyurethane resins, epoxy resins, silicone resins, polyamide resins and modified rosin are also preferable examples.

Among these, polyester resins are particularly preferred as the binder resin in the exemplary embodiment. Such polyester resins include crystalline polyester resin and non-crystalline polyester resin, both of which may be used in the exemplary embodiment. A crystalline polyester resin and a non-crystalline polyester resin may each be used solely as a binder resin, but these are preferably used together.

In the exemplary embodiment, the term "crystalline polyester resin" refers to a resin that shows, in a differential scanning calorimetry (DSC), not a stepwise change in an endothermic value but a clear endothermic peak. In contrast, a resin which shows a stepwise change in an endothermic value in DSC is a non-crystalline polyester resin in the exemplary embodiment.

-Crystalline Polyester Resin-

The toner of the exemplary embodiment realizes low-temperature fixation by containing a crystalline polyester resin. The low-temperature fixation unit an operation of heating a toner at a temperature of about 120° C. or lower to fix it (under conditions including a process speed of 100 mm/s, a sheet of 80 gsm, and a toner amount per unit area of 1.5 mg/cm$^2$).

In the exemplary embodiment, the crystalline polyester resin unit a resin that shows a distinct endothermic peak, not a stepwise change in the endothermic value thereof in differential scanning calorimetry (DSC) as mentioned above. A copolymer in which other ingredients are copolymerized to the main chain of a crystalline polyester resin is also referred to as a crystalline resin as long as the content of other ingredients is 50% by constituent mole or less. Namely, those showing an endothermic peak are included in the crystalline polyester resin. Examples of the crystalline polyester resin are given below, and are however not limitative thereto.

In the crystalline polyester resin, examples of an acid which is to be an acid-derived constitutent component include various dicarboxylic acids. Among them, an aliphatic dicarboxylic acid and an aromatic dicarboxylic acid are preferable, and, in particular, a straight chain carboxylic acid is desirable as the aliphatic dicarboxylic acid. The dicarboxylic acid as the acid-derived component is not limited to one, and two or more kinds of the dicarboxylic acid-derived components may be contained. The dicarboxylic acid may include a sulfonic acid group in order to improve emulsifiability in an emulsification and aggregation method.

The "acid-derived component" refers to a constituent moiety which was an acid component before the synthesis of the polyester resin and the "alcohol-derived component" refers to a constituent moiety which was an alcohol component before the synthesis of the polyester resin.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkyl esters thereof and acid anhydrides thereof. However, the aliphatic dicarboxylic acid is not limited to these. Among them, in view of availability, adipic acid, sebacic acid, 1,10-decanedicarboxylic acid, and 1,12-dodecanedicarboxylic acid are preferable.

An aromatic dicarboxylic acid may be added to the aliphatic dicarboxylic acid, and examples of the aromatic dicarboxylic acid include terephthalic acid, isophthalic acid, orthophthalic acid, t-butylisophthalic acid, 2,6-naphthalenedicarboxylic acid, 4,4'-biphenyldicarboxylic acid, and the like. Among them, terephthalic acid, isophthalic acid, and t-butylisophthalic acid are preferable in view of availability and easy emulsification. As for the addition amount of these aromatic dicarboxylic acids, it is preferably 20% or less by constituent mole, more preferably 10% or less by constituent mole, and still more preferably 5% or less by constituent mole. If the addition amount of the aromatic dicarboxylic acid is more than 20% by constituent mole, there may be cases where emulsification becomes difficult, or where crystallinity is inhibited so that an image gloss peculiar to the crystalline polyester resin can be obtained, or further where a melting temperature depression is caused to worse also the storability of the image.

In the crystalline polyester resin, the alcohol for an alcohol-derived component may be an aliphatic diol, and specific examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like. However, the aliphatic diol is not limited to these. Among them, in view of availability, ethylene glycol, 1,4-butanediol, 1,6-hexanediol, 1,9-nonanediol, and 1,10-decanediol are preferable.

In the above alcohol-derived component, the content of the aliphatic diol-derived component is preferably 80% by constituent mole or 80% or more by constituent mole, and more preferably 90% by constituent mole or 90% or less by constituent mole. The alcohol-derived component includes other components if necessary. If the content of the above aliphatic diol-derived component is less than 80% by constituent mole, the crystallinity of the polyester resin may lower, and thus the melting temperature may drop. As a result, the toner blocking resistance, the image storability, or the low temperature fixability may be deteriorated.

The other components which may be included as needed are constituent components such as a diol-derived component having a double bond(s), a diol-derived component having a sulfonic acid group, and the like. Examples of the above diol having a double bond include 2-butene-1,4-diol, 3-butene-1,6-diol, 4-butene-1,8-diol, and the like. The content of the diol-derived component having a double bond is preferably 20% or less by constituent mole and is more preferably from 2% by constituent mole to 10% by constituent mole, with respect to the entire alcohol-derived components. If the content of the diol-derived component having a double bond is more than 20% by constituent mole, the crystallinity of the polyester resin may lower or the melting temperature may drop, and therefore the storability of an image may be deteriorated.

As the crystalline polyester resin in the exemplary embodiment, aliphatic crystalline polyester resins are preferable. The constituent ratio of the aliphatic polymerizable monomer that is a constituent component of the aliphatic crystalline polyester resin is preferably 60 mol % or about 60 mol % or more, and more preferably 90 mol % or about 90 mol % or more. As the aliphatic polymerizable monomer, the above-described aliphatic diol or dicarboxylic acid is preferably used.

In this case, an aliphatic crystalline polyester resin obtained by reacting a dicarboxylic acid having 10 to 12 carbon atoms with a diol having 4 to 9 carbon atoms is preferable. By limiting the carbon number within this range, a crystalline polyester resin which has a melting temperature suitable for a toner is easily obtained, and the linearity of the resin structure increases, and therefore an affinity to non-crystalline polyester resins increases because the polyester is aliphatic.

It is more preferred that the dicarboxylic acid has 10 to 12 carbon atoms and diol has 6 to 9 carbon atoms.

The above crystalline polyester resin may be manufactured at a polymerization temperature of 180° C. to 230° C. Pressure within the reaction system is reduced as need arive, and the reaction is carried out while removing water or alcohol which is generated at the time of condensation.

When the polymerizable monomer does not dissolve or is not miscible at the reaction temperature, a solvent having a high boiling temperature may be added thereto as an auxiliary solubilizer to dissolve the monomer. The polycondensation reaction is effected while removing the auxiliary solubilizer by distillation. When a poorly miscible monomer is present in the copolymerization reaction, the poorly miscible polymerizable monomer is subjected to condensation beforehand with an acid or alcohol which is scheduled for polycondensation, and then the condensed product is subjected to polycondensation with the main component.

Examples of a catalyst that may be used in the manufacturing of the crystalline polyester resin include alkali metal compounds of sodium or lithium; alkaline earth metal compounds of magnesium or calcium; metallic compounds of zinc, manganese, antimony, titanium, tin, zirconium, or germanium; phosphite compounds; phosphate compounds; and amine compounds.

The weight average molecular weight (Mw) of the crystalline polyester resin is preferably in a range of from equal to or about 6,000 to equal to or about 35,000, and more preferably 6,000 to 30,000. If the molecular weight (Mw) is less than 6,000, the toner may decrease the strength of the fixed image for bending resistance, and if the weight average molecular weight (Mw) is more than 35,000, it becomes difficult to be taken into the non-crystalline resin having a high molecular weight.

The above-described weight average molecular weight may be determined by gel permeation chromatography (GPC). The molecular weight determination by GPC is carried out using a GPC•HLC-8120, a measuring apparatus manufactured by Tosoh Corporation, TSK gel Super HM-M (15 cm), a column manufactured by Tosoh Corporation, and THF as a solvent. The weight average molecular weight is calculated from the measured value using a molecular weight calibration curve which have been prepared with a monodispersed polystyrene standard sample.

The melting temperature (Tm) of the crystalline polyester resin used in the exemplary embodiment is preferably in a range from equal to or about 60° C. to equal to or about 120°

C., and more preferably in a range of 70° C. to 100° C. If the melting temperature of the crystalline polyester resin is less than 60° C., toner powder aggregation may easily occur, and storability of the fixed image may be impaired. On the other hand, if the melting temperature is higher than 120° C., low-temperature fixation may be inhibited due to rough image occurrence.

The melting temperature of the above crystalline polyester resin is determined as a peak temperature of the endothermic peak obtained by the differential scanning calorimetry (DSC) as mentioned above.

The content of the crystalline polyester resin in the toner is preferably in a range of equal to or about 1% by weight to equal to or about 40% by weight, more preferably in a range of 3% by weight to 20% by weight. When the content of the crystalline polyester resin is less than 1% by weight, a sufficient fixability at low temperature is not obtained in some cases. Further, when the content of the crystalline polyester resin is more than 40% by weight, toner crushing due to the softness of the crystalline resin is occurred, and filming of the photoreceptor as well as image defect due to contamination of the members in the image formation system using a charge roll and a transfer roll is easy to occur.

-Non-Crystalline Polyester Resin-

As the non-crystalline resin used in the exemplary embodiment, known polyester resins may be used. The non-crystalline polyester resin used is synthesized from a polyvalent carboxylic acid component and a polyhydric alcohol component. Referring to the above non-crystalline polyester resin, a commercially available product may be used or synthesized product may be used, and one of the non-crystalline polyester resin may be used, or a mixture of two or more of the polyester resins may also be used.

Examples of the above-described polyhydric alcohol component in the non-crystalline polyester resin include divalent alcohol components such as ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, polyethylene glycol, polypropylene glycol, bisphenol A, and hydrogenated bisphenol A, etc. In addition, as alcohol components having a valency of three or more, glycerine, sorbitol, 1,4-sorbitan, trimethylolpropane and the like may be used.

Examples of the divalent carboxylic acid component which may be condensed with the above polyhydric alcohol component include aromatic carboxylic acids such as terephthalic acid, isophthalic acid, phthalic anhydride, trimellitic anhydride, pyromellitic acid, and naphthalenedicarboxylic acid; aliphatic saturated carboxylic acids such as succinic acid, alkenylsuccinic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aliphatic unsaturated dicarboxylic acids such as maleic acid, maleic anhydride, fumaric acid, itaconic acid, itaconic anhydride, citraconic acid, citraconic anhydride, and methaconic acid; alicyclic carboxylic acids such as cyclohexanedicarboxylic acid; and lower alkyl esters thereof and acid anhydrides thereof. One or two or more of these polyvalent carboxylic acids may be used.

Among these polyvalent carboxylic acids, aliphatic unsaturated dicarboxylic acids are preferable in view of improving an affinity to the crystalline polyester resin of which the structure is highly linear because aliphatic unsaturated dicarboxylic acids have a planar structure. Especially, fumaric acid is preferable, since carboxy groups are located at the trans-position of the double bond, and the linearity of the resin structure as well as the affinity is further enhanced.

In addition, when an alkenylsuccinic acid or an anhydride thereof is used, the presence of an alkenyl group that is more hydrophobic compared to other functional groups may enable the crystalline polyester resin to be mutually dissolved more easily. Examples of the alkenylsuccinic acid include n-dodecylsuccinic acid, n-dodecenylsuccinic acid, isododecylsuccinic acid, isododecenylsuccinic acid, n-octylsuccinic acid, n-octenylsuccinic acid, and acid anhydrides thereof, acid chlorides thereof and esters thereof with lower alkyl having 1 to 3 carbon atoms.

Furthermore, by containing a carboxilic acid having a valency of thee or more, a polymer chain may take a crosslinking structure, and such a crosslinking structure may exhibit an effect of fixing the crystalline resin which has been once mutually dissolved with the non-crystalline resin and of making the separation difficult.

Examples of the carboxilic acid having a valency of three or more include trimellitic acid such as 1,2,4-benzenetricarboxylic acid and 1,2,5-benzenetricarboxylic acid, 1,2,4-naphthalenetricarboxylic acid, hemimellitic acid, trimesic acid, mellophanic acid, prehnitic acid, pyromellitic acid, mellitic acid, 1,2,3,4-butanetetracarboxylic acid, acid anhydrides thereof, acid chlorides thereof and esters thereof with lower alkyl having 1 to 3 carbon atoms. Among these, trimellitic acid is especially suitable. These may be used solely, or two or more of them may be used in combination.

The acid component may include a dicarboxylic acid component having a sulfonic acid group, in addition to the aliphatic dicarboxylic acids and aromatic dicarboxylic acids. The dicarboxylic acid having the sulfonic acid group is effective in view of enabling a coloring material such as pigments to be dispersed favorably. Further, in the production of a dispersion of binder resin particles by emulsifying or suspending the whole resin in water, if the dicarboxylic acid component has a sulfonic acid group, emulsification or suspension can be, as mentioned later, performed without surfactants.

From the above reason, it is desirable that the non-crystalline polyester resin contains a component obtained by reacting at least one of aliphatic unsaturated dicarboxylic acids and anhydrides thereof, at least one of alkenylsuccinic acids and anhydrides thereof and at least one of trimellitic acid and anhydrides thereof. Moreover, as mentioned above, the amount of the aliphatic unsaturated dicarboxylic acid in the entire acid components is such that those in the low molecular weight non-crystalline polyester resin is higher that those in the high molecular weight non-crystalline polyester resin.

The polymerization method accords with the method as in the case of the crystalline polyester resin.

The molecular weight of the non-crystalline polyester resin is not particularly limited and, for example, in the case where a resin of a high molecular weight component and a resin of a low molecular weight component are each synthesized and the products are served as a binder resin, the weight average molecular weight Mw of the high molecular weight component is preferably in a range of from equal to or about 30,000 to equal to or about 200,000, more preferably in a range of 30,000 to 100000, and still more preferably 35,000 to 80,000.

By controlling the molecular weight of the high molecular weight component within this range, shell effect that the outermost surface is covered with non-crystalline polyester resin can be effectively expressed in the aggregation process. If the molecular weight Mw is more than 200,000, melting/coalescing may require higher temperature and/or longer time, and therefore, the crystalline polyester resin or the like may be exposed from the inside, and thus the shell effect might not be obtained. Reversely, if Mw is less than 30000, the affinity may be enhanced due to the low molecular weight and the shell effect might not be obtained.

The Mw of the low molecular weight component resin is preferably in a range of from equal to or about 8,000 to equal to or about 25,000, even more preferably in a range of 8,000 to 22,000, and further preferably in a range of 9,000 to 20,000.

By controlling the molecular weight of the low molecular weight component within this range, composite particle formation with the crystalline polyester resin at the initial stage of the aggregation process proceeds easily, so that uniform toner particles are easily formed. If the Mw becomes more than 25000, composite particle formation with the crystalline polyester resin may not proceed smoothly, and aggregates solely of the crystalline resin might be easy to be formed. Reversely, if the Mw is less than 8000, the strength of the resin may be decreased so that sufficient image strength and toner strength might not be obtained.

In the production of a binder resin by mixing a resin of the high molecular weight component with a resin of the low molecular weight component, the mixing ratio P/Q (P: weight of high molecular weight component, Q: weight of low molecular weight component) of both components is preferably in a range of from equal to or about 10/90 to equal to or about 70/30, more preferably 20/80 to 70/30, and still more preferably 25/75 to 70/30.

(Colorant)

While the colorant to be used for the toner of the exemplary embodiment may be either dye or a pigment, a pigment is preferable from the viewpoints of light fastness and water resistance.

Examples of yellow pigments include chrome yellow, zinc chromate, yellow iron oxide, Cadmium Yellow, Chrome Yellow, Hansa Yellow, Hansa Yellow 10G, Benzidine Yellow C, Benzidine Yellow GR, Threne Yellow, Quinoline Yellow and Permanent Yellow NCG. In particular, C.I. Pigment Yellow 17, C.I. Pigment Yellow 74, C.I. Pigment Yellow 97, C.I. Pigment Yellow 155, C.I. Pigment Yellow 180, C.I. Pigment Yellow 185 are preferably used.

Examples of magenta pigments include colcothar, Cadmium Red, red lead, mercury sulfide, Watchung Red, Permanent Red 4R, Lithol Red, Brilliant Carmine 3B, Brilliant Carmine 6B, DuPont Oil Red, Pyrazolone Red, Rhodamine B Lake, Lake Red C, Rose Bengal, Eoxine Red and Alizarine Lake. Examples of naphthol pigments include Pigment Red 31, 146, 147, 150, 176, 238 and 269. Examples of quinacridone pigments include Pigment Red 122, 202 and 209. Among these, Pigment Red 185, 238, 269 and 122 are preferred from the viewpoints of producibility and charging property.

Examples of cyan pigments include Prussian Blue, Cobalt Blue, Alkaline Blue Lake, Victoria Blue Lake, Fast Sky Blue, Indanthrene Blue BC, Aniline Blue, Ultramarine Blue, Carcoil Blue, Methylene Blue Chloride, Phthalocyanine Blue, Phthalocyanine Green and Malachite Green Oxalate. In particular, C.I. Pigment Blue 15:1, C.I. Pigment Blue 15:3 are preferably used.

Examples of orange pigments include red chrome yellow, Molybdenum Orange, Permanent Orange GTR, Pyrazolone Orange, Vulcan Orange, Benzidine Orange G, Indanthrene Brilliant Orange RK and Indanthrene Brilliant Orange GK. Examples of violet pigments include manganese violet, Fast Violet B and Methyl Violet Lake. Examples of green pigments include chromium oxide, Chrome Green, Pigment Green, Malachite Green Lake and Final Yellow Green G.

Examples of white pigments include zinc flower, titanium oxide, antimony white and zinc sulfide.

Examples of extender pigments include baryte powder, barium carbonate, clay, silica, white carbon, talc and alumina white. Various dyes may also be used, e.g. acridine dyes, xanthene dyes, azo dyes, benzoquinone dyes, azine dyes, anthraquinone dyes, thioindigo dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes and xanthene dyes. Such colorants are used solely or in combination.

Examples of black pigments to be used for black toners include carbon black, copper oxide, manganese dioxide, aniline black and activated carbon. In particular, carbon black is preferably used. Carbon black does not necessarily need special dispersion because of its relatively good dispersibility, but it is preferably produced by a production method according to that of colored colorants.

The content of the above-described colorant in the toner for electrostatic charge image development of an exemplary embodiment is preferably in a range of 1 parts by weight to 30 parts by weight with respect to 100 parts by weight of the binder resin. Further, as needed, a surface-treated colorant may be used or a pigment dispersant may be used. By selecting the colorant, a yellow toner, magenta toner, cyan toner, black toner or the like is obtained.

(Releasing Agent)

In the toner of the exemplary embodiment, a releasing agent is further contained.

Examples of the releasing agent include low molecular weight polyolefins such as polyethylene, polypropylene and polybutene; silicones having a softening temperature; fatty acid amides such as oleic amide, erucic amide, ricinoleic amide and stearic amide; vegetable waxes such as carnauba wax, rice wax, candelilla wax, Japan wax and jojoba oil; animal waxes such yellow bees wax; mineral or petroleum waxes such as montan wax, ozokerite, ceresin, paraffin wax, microcrystalline wax, and Fischer-Tropsch wax; ester waxes of a higher fatty acid and a higher alcohol such as stearyl stearate and behenyl behenate; ester waxes of higher fatty acids and mono- or polyhydric lower alcohols such as butyl stearate, propyl oleate, glyceride monostearate, glyceride distearate and pentaerythritol tetrabehenate; ester waxes of higher fatty acids and polyhydric alcohol polymers such as diethylene glycol monostearate, dipropylene glycol distearate, diglyceride distearate and triglyceride tetrastearate; sorbitan higher fatty acid ester waxes such as sorbitan monostearate; and cholesterol higher fatty acid ester waxes such as cholesteryl stearate.

In the exemplary embodiment, such releasing agents may be used solely or two or more releasing agents may be used in combination.

The releasing agent in the exemplary embodiment preferably has a melting temperature (a main maximum endothermic peak temperature) measured by differential scanning calorimetry (DSC) in accordance with ASTMD3418-8 within a range of 75° C. to 100° C., and more preferably within a range of 80° C. to 90° C.

If the melting temperature is lower than 75° C., the viscosity of the releasing agent will become extremely low at the time of fusion of emulsified fine particles in the production of a toner by the emulsification and aggregation method, described later and the ratio of toner with a small particle size and a high circularity will increase and, as a result, it may be impossible to adjust the number particle diameter distribution/circularity degree distribution to desired ranges. If it exceeds 100° C., the releasing agent will not melt well even at temperatures of fusion or the like due to its excessively high change temperature and, as a result, it may not participate in control of particle diameter distribution/circularity degree distribution.

From the above-mentioned viewpoints, due to the fusion temperature in the toner production described later, the releasing agent to be used is preferably carnauba wax, rice wax, candelilla wax, paraffin wax, microcrystalline wax, polyethylene, polypropylene. In particular, when a polyester resin is used as a binder resin, it is preferable to use paraffin wax, microcrystalline wax, or polyethylene.

The content of the releasing agent in the toner is preferably from 0.5% by weight to 15% by weight, and more preferably from 1.0% by weight to 12% by weight. If the content of the releasing agent is less than 0.5% by weight, defective release may occur particularly in oil-free fixation. If the content of the releasing agent is greater than 15% by weight the image quality and the reliability of image formation may decrease due to, for example, deterioration of the fluidity of a toner.

(Other Additives)

To the toner of an exemplary embodiment, in addition to the above-described components, various components such as an internal additive, charge controlling agent, inorganic powder (inorganic particles), or organic particles may be added as needed.

Examples of the internal additive include metals such as ferrite, magnetite, reduced iron, cobalt, nickel, or manganese, alloys thereof, and magnetic substances such as a compound containing these metals.

The inorganic particles may be added for various purposes, and, for example, may be added for adjusting the viscoelastic property in the toner. By adjusting of the viscoelastic property, the glossiness of the image and the penetration of the toner into paper may be adjusted. As the inorganic particles, known inorganic particles such as silica particles, titanium oxide particles, alumina particles, cerium oxide particles, or particles obtained by subjecting these particles to surface hydrophobization may be used alone or in combination of two or more of them. From the viewpoints of not impairing the color forming property and transparency such as OHP transmittance, silica particles which have a smaller refractive index than a binder resin may be used as the inorganic particles. Further, silica particles may have been subjected to various surface treatments, and for example, those have been subjected to surface treatment with a silane-based coupling agent, titanium-based coupling agent, or silicone oil are preferably used.

Moreover, known materials such as a charge controlling agent may be added to the toner. The average particle diameter of a material to be added is preferably 1 μm or less, and more preferably 0.01 μm to 1 μm. If the average particle diameter exceeds 1 μm, the particle diameter distribution of the finally obtained toner for electrophotography will become broad or free particles will generate and, as a result, the performance or reliability may deteriorate. On the other hand, when the average particle diameter is within a range, the above problems do not occur, uneven distribution of the material among toners decreases, and dispersion of the material in the toner is improved, whereby it is advantageous that fluctuation of performance and reliability is minimized. The average particle diameter can be determined by using a Microtruck, for example.

The toner for developing an electrostatic charge image of the exemplary embodiment will be described in detail below along with the method for producing the same. The method for producing the toner of the exemplary embodiment, which is not particularly restricted, is preferably performed by a wet granulation method. The wet granulation method preferably includes known methods such as a fusion and suspension method, an emulsification and aggregation method and a dissolution and suspension method. The method is described below by taking the emulsification and aggregation method as an example.

The emulsification and aggregation method is a production method including a process of forming aggregated particles in a dispersion in which particles containing at least a resin are dispersed (emulsified), which dispersion may hereinafter be referred to as an "emulsion", to prepare an aggregated particle dispersion (aggregation process), and a process of heating the aggregated particle dispersion to fuse the aggregated particles (fusion process). The method may further include a process of forming adhered particles by adding and mixing a particle dispersion prepared by dispersing particles in the aggregated particle dispersion, thereby adhering the particles to the aggregated particles (adhesion process) between the aggregation process and the fusion process. While in the adhesion process, the particle dispersion is added and mixed in the aggregated particle dispersion prepared in the aggregation process, thereby forming adhered particles by adhering the particles to the aggregated particles, the particles to be added may be called "additional particles" because they are particles which are to be newly added to the aggregated particles.

As the additional particles, a combination of the resin with one or two or more species selected from among releasing agent particles, colorant particles and the like is also available. The method of adding and mixing the particle dispersion is not particularly restricted. For example, the addition and mixing may be performed slowly and continuously, or alternatively may be performed stepwise in two or more separate stages. Addition and mixing of the particles (additional particles) in such a manner makes it possible to inhibit the generation of fine particles to sharpen the particle diameter distribution of resulting toner particles, thereby contributing to improvement in image quality. Moreover, the addition of the adhesion process makes it possible to form a pseudo shell structure. Consequently, the exposure in the toner surface of internal additives such as a colorant and a releasing agent may be reduced, and as a result, the charging property or durability may be improved. Further at the time of fusion in the fusion process, it is possible to maintain the particle diameter distribution to control its fluctuation, and it is possible to eliminate the need for addition of a surfactant or a stabilizer such as a base or an acid for increasing the stability during the fusion or to minimize the addition amount of such agents. It is advantageous in that it may reduce the cost or may improve the quality.

Hereafter, a more preferable method for producing the toner of the exemplary embodiment is explained by taking, as an example, a case where a polyester resin is used as a binder resin.

A preferable method for producing the toner in the exemplary embodiment includes an emulsification process of adding an aqueous solvent to a mixture of a binder resin composed of a polyester resin, a colorant and an organic solvent to perform phase inversion emulsification or emulsifying and dispersing the mixture in an aqueous solvent, thereby preparing a dispersion of composite particles containing the binder resin and the colorant, an aggregation process of aggregating the composite particles and releasing agent particles in the dispersion to form aggregated particles, and a fusion process of fusing and coalescing the aggregated particles at a temperature equal to or lower than the melting temperature of the releasing agent.

As mentioned previously, the toner of the exemplary embodiment is a toner in which a content ratio for each region specified by particle diameter distribution/circularity distribution is adjusted to the most effective range. The control of this content ratio can be attained, for example, by elaborating the conditions of the emulsification process and the fusion process in the emulsification and aggregation method.

By forming composite particles containing a colorant in resin in the emulsification process and using the composite particles to obtain in the aggregation process, it is possible to control the melt-deformation rate of the resin at a melting temperature by the filler effect of the colorant to reduce the ratio of small particle size/high circularity toner to control the particle diameter distribution/circularity distribution to desired ranges. Moreover, by aggregating releasing agent particles with the composite particles to obtain aggregated particles in the aggregation process and fusing the resulting aggregated particles at a temperature which is equal to or lower than the melting temperature of the releasing agent or less, it is possible to inhibit the melt-deformation of the resin at a melting temperature by increasing the viscosity of the releasing agent to reduce the ratio of small particle size/high circularity toner to control the particle diameter distribution/circularity distribution to desired ranges. Therefore, the toner of the exemplary embodiment can be obtained by using the emulsification and aggregation method possessing the above two features.

-Emulsification Process-

In the case of using a non-crystalline polyester resin or a crystalline polyester resin in the emulsification and aggregation method, an emulsification process of emulsifying a polyester resin to form emulsified particles (droplets) is preferred.

In the case of obtaining composite particles by the phase inversion emulsification method, an emulsion (composite particle dispersion) can be obtained by dissolving at least a polyester resin and a colorant in an organic solvent, adding a neutralizer or a dispersion stabilizer according to demand, dropping an aqueous solvent under stirring, thereby obtaining emulsified particles, and then removing the solvent in the dispersion. In this process, the order of feeding of the neutralizer or the dispersion stabilizer may be changed.

The addition amount of the colorant is adjusted preferably to a range of 1% by weight to 20% by weight, and more preferably to a range of 1% by weight to 10% by weight, with respect to total amount of the resin components including the polyester resin.

The mixing of the polyester resin with the colorant may be performed by mixing the colorant or an organic solvent dispersion of the colorant to an organic solvent solution of the resin component.

Examples of the organic solvent in which the resin is to be dissolved include formic acid esters, acetic acid esters, butyric acid esters, ketones, ethers, benzenes and halogenated carbons. Specifically, fatty acid esters of formic acid, acetic acid, or butyric acid and methyl, ethyl, n-propyl, isopropyl, n-butyl, isobutyl, sec-butyl, or tert-butyl; methyl ketones such as acetone, MEK, MPK, MIPK, MBK and MIBK; ethers such as diethyl ether and diisopropyl ether, heterocycle-substituted compounds of toluene, xylene or benzene; halogenated carbons such as carbon tetrachloride, methylene chloride, 1,2-dichloroethane, 1,1,2-trichloroethane, trichloroethylene, chloroform, monochlorobenzene and dichloroethylidene may be used solely or as a mixture of two or more of them. From the viewpoints of availability, recoverability in desolventing, and environmental consideration, acetic acid esters, methyl ketones and ethers, which are solvents having a low boiling temperature, are usually, preferably used. In particular, acetone, methyl ethyl ketone, acetic acid, ethyl acetate, and butyl acetate are preferred. The organic solvent may serve as a VOC-causing substance if it remains in resin particles. Therefore, use of an organic solvent having a relatively high volatility is preferred. As the usage amount of such an organic solvent, an amount of 20% by weight to 200% by weight, preferably 30% by weight to 100% by weight with respect to the amount of the resin is chosen.

As the above-mentioned aqueous solvent, ion exchange water is used basically, and it may contain a water-soluble organic solvent to an extent that an oil droplet is not destroyed. Such a water-soluble organic solvent include short carbon chain alcohols such as methanol, ethanol, 1-propanol, 2-propanol, 1-butanol, 2-butanol, tert-butanol, 1-pentanol; ethylene glycol monoalkyl ethers such as ethylene glycol monomethyl ether, ethylene glycol monoethyl ether and ethylene glycol monobutyl ether; ethers, diols, THF and acetone. Ethanol and 2-propanol are preferably used. As the usage amount of such a water-soluble organic solvent, an amount of 1% by weight to 60% by weight, preferably 5% by weight to 40% by weight to the amount of the resin is chosen. The water-soluble organic solvent may be used not only by being mixed with ion exchange water to which the solvent is to be added, but also by being added into a resin solution. In the case of adding a water-soluble organic solvent, it is possible to adjust the wettability between the resin and a solvent in which the resin is to be dissolved. Moreover, a function to reduce the liquid viscosity after the resin dissolution may be expected.

A dispersing agent may be added to a resin solution and an aqueous component according to demand so that the emulsion may keep a dispersed state stable. The dispersing agent is a substance which forms hydrophilic colloid in an aqueous component, and specific examples thereof include cellulose derivatives such as hydroxymethyl cellulose, hydroxyethyl cellulose and hydroxypropyl cellulose; and dispersion stabilizers such as synthetic polymers, e.g. polyvinyl alcohol, polyvinyl pyrrolidone, polyacrylamide, polyacrylic acid salts and polymethacrylic acid salts; gelatin, gum arabic and agar. Solid fine powders of silica, titanium oxide, alumina, tricalcium phosphate, calcium carbonate, calcium sulfate, barium carbonate may also be used. Such a dispersion stabilizer is added usually so that its concentration in an aqueous component will become 0% by weight to 20% by weight, preferably 0% by weight to 10% by weight.

A surfactant is also used as the dispersing agent. As examples of the surfactant, substances such as those to be used for a colorant dispersion described later may be used. Examples thereof include natural surfactant components such as saponin; cationic surfactants, such as alkylamine hydrochloric acid/acetic acid salts, quarternary ammonium salts and glycerol; and anionic surfactants such as fatty acid soaps, sulfates, alkyl naphthalene sulfonates, sulfonates, phosphoric acid, phosphates and sulfosuccinates. Anionic surfactants and nonionic surfactants are preferably used.

If the polyester resin to be used as a binder resin is emulsified directly, the pH of the solution will become 3 to 4 and the polyester resin may be hydrolyzed. Therefore, in the exemplary embodiment, the pH at the time of emulsification is adjusted to nearly neutral by addition of a basic substance to the solution, thereby emulsifying the polyester resin. Thereby, emulsification can be performed without being accompanied by hydrolysis of the polyester resin. In the exemplary embodiment, the pH of the emulsion is preferably 4.5 to 9.5, more preferably 5 to 9, and even more preferably 6 to 8 from the viewpoint of preventing the occurrence of hydrolysis.

Examples of the basic substance include inorganic bases such as sodium hydroxide, potassium hydroxide, lithium hydroxide, calcium hydroxide, sodium carbonate, sodium hydrogencarbonate, potassium hydrogencarbonate and ammonia, and organic bases such as diethylamine, triethylamine and isopropylamine.

As a method for removing the organic solvent from the emulsion, a method of volatilizing the organic solvent from the emulsion at 15° C. to 70° C. and a method of combining pressure reduction with the above method are preferably used.

The volume average particle diameter of composite particles which are emulsified particles obtained in the emulsification process is preferably 0.01 μm to 1 μm, more preferably 0.03 μm to 0.8 μm, and even more preferably 0.03 μm to 0.6 μm.

On the other hand, the emulsified particles (droplets) of the polyester resin may be formed by adding a shearing force to a solution obtained by mixing an aqueous medium and a mixed liquid (polymer liquid) containing a polyester resin, a colorant and an organic solvent. When a non-crystalline polyester resin is used in this process, emulsified particles can be formed by reducing the viscosity of a polymer liquid by heating it to a temperature equal to or higher than the glass transition temperature of the resin. A dispersing agent may also be used for stabilizing the emulsified particles or thickening the aqueous medium.

Examples of the emulsifying machine to be used in forming the emulsified particles include continuous emulsification/dispersion apparatuses such as Homomixer (manufactured by Tokushu Kika Kogyo Co., Ltd.), Slasher (manufactured by Mitsui Mining Co., Ltd.), Cavitron (manufactured by Eurotec, Ltd.), Clearmix (manufactured by M Technique Co., Ltd.), Microfluidizer (manufactured by Mizuho Industrial Co., Ltd.), Munton-Golin Homogenizer (manufactured by Gaulin Co.), Nanomizer (manufactured by Nanomizer Co., Ltd.) and Static Mixer (manufactured by Noritake Co.). Emulsification dispersion may be performed also by using an ordinary stirring machine and various types of stirring blades.

The organic solvent, dispersing agent and basic substance to be used in the emulsification by addition of a shearing force, and the emulsification temperature and the volume average particle diameter of emulsified particles (composite particles) are similar to those in the phase inversion emulsification.

It is preferable to produce not only the dispersion containing the composite particles but also a dispersion of the releasing agent particles to be used for the aggregation process mentioned later.

As the method for dispersing the releasing agent, common dispersing methods using, for example, a rotary shear type homogenizer or a ball mill, a sand mill, a Dynomill which have media may be used with no particular limitations. The volume average particle diameter of the releasing agent particles is preferably adjusted to 0.05 μm to 0.3 μm.

According to need, an aqueous dispersion of such a releasing agent may be prepared using a surfactant or alternatively an organic solvent dispersion of such a releasing agent in an organic solvent may be prepared using a dispersing agent. Hereinafter, the dispersion of releasing agent particles may be referred to as a "releasing agent dispersion". As the surfactant and the dispersing agent to be used for the dispersion, those like dispersing agents which can be used for dispersing the polyester resin can be used.

-Aggregation Process-

In the aggregation process, the obtained dispersion of the composite particles and dispersion of the releasing agent are mixed to make a mixed liquid, and the liquid is heated at a temperature equal to or lower than the glass transition temperature of the non-crystalline resin to cause aggregation, thereby to form aggregated particles. The formation of the aggregated particles is carried out by adjusting the pH of the mixed liquid to be acidic while stirring. The pH is preferably in a range of 2 to 7, more preferably in a range of 2.2 to 6, and even more preferably in a range of 2.4 to 5. On this occasion, it is also effective to use a floculant.

The weight ratio of the composite particles to the releasing agent particles to be mixed (composite particles/releasing agent) is adjusted preferably to a range of 97/3 to 80/20, and more preferably to a range of 95/5 to 85/15. If the amount of the releasing agent particles is excessively small, the proportion of aggregation of composite particles becomes high, so that the control of particle size and circularity in the fusion process may become insufficient. If the amount of the releasing agent particles is excessively large, properties as a toner (charging property, fluidity) may deteriorate.

As the floculant to be used, a surfactant having a polarity opposite to the polarity of the above surfactant used as the dispersant, as well as an inorganic metal salt, and a metal complex having a valency of two or more may be preferably used. In particular, a metal complex is particularly preferable because the usage amount of surfactant can be reduced and the charging property is improved.

Examples of the inorganic metal salt include metal salts such as calcium chloride, calcium nitrate, barium chloride, magnesium chloride, zinc chloride, aluminum chloride, or aluminum sulfate, and inorganic metal salt polymers such as polyaluminum chloride, polyaluminum hydroxide, or calcium polysulfide. Among them, aluminum salts and polymers thereof are preferable. For obtaining a sharper particle diameter distribution, with regard to the valence of the inorganic metal salt, divalent is better than monovalent, trivalent is better than divalent and tetravalent is better than trivalent.

While the addition amount of the floculant varies with the type and valence of the floculant, it is almost within a range of 0.05% by weight to 0.2% by weight. The floculant will flow out into an aqueous medium or will form a coarse powder during a toner production process, and therefore all the floculant added does not necessarily remain in the toner. In particular, when a large amount of solvent is in the resin in the toner production process, the solvent and the floculant are prone to interact with each other to flow out into the aqueous medium. Therefore, the addition amount of the floculant must be adjusted in conformity with the amount of the remaining solvent.

In this process, the composite particles aggregate to form aggregated particles with a size as large as that of a toner which will be formed finally. In the exemplary embodiment, it is preferable to adjust the particle diameter of the aggregated particles from 3.0 μm to 8.0 μm.

In the aggregated particles, it is preferable that releasing agent particles be in an unfused state and be present between composite particles. Therefore, it is preferable to perform mixing at an initial mixing temperature adjusted to 10° C. or lower, more preferably to 5° C. or lower.

-Fusion Process-

In a fusion process, the advancement of aggregation is stopped by increasing the pH of a suspension of aggregated particles into a range of 3 to 9 under stirring conditions like those of the aggregation process, and heating is conducted at a temperature which is equal to or higher than the glass transition temperature of the non-crystalline polyester resin or the melting temperature of the crystalline polyester resin, thereby fusing the aggregated particles. On this occasion, the fusion temperature is adjusted to a temperature of the melting temperature of the releasing agent or lower.

It is more preferable to adjust the fusion temperature to a temperature which is equal to or higher than the melting temperature of the crystalline polyester resin and which is 5° C. to 10° C. lower than the melting temperature of the releasing agent.

By using a fusion temperature which is equal to or higher than the melting temperature of the crystalline polyester resin, the compatibility between the crystalline polyester resin and the non-crystalline resin is promoted. By using a fusion temperature which is equal to or lower than the melting temperature of the releasing agent, it is possible to render precise control of shape/shape distribution through the control of the amount of low-viscosity components (releasing agent/crystalline polyester resin) in the aggregated particles and the inhibition of a rapid change in shape of the aggregated particles.

As for the time of heating, it is only required that the heating is performed so that desired coalescence will be attained, that is, for about 0.5 hours to about 20 hours. Then, when the temperature is lowered to the Tg of the resin or lower and thereby particles solidify, the shape of particles and the surface property will vary with the temperature reduction rate. For example, when the temperature is reduced at a high rate, spherization and surface irregularities are prone to be decreased, whereas when the temperature is reduced slowly, the shape of particles will become irregular and irregularities are prone to occur on particle surfaces. Therefore, it is preferable to reduce the temperature to the Tg of the resin or lower at a rate of 3.0° C./min or more, and more preferably at a rate of 10° C./min or more.

Moreover, by appropriately changing the pH, the salt concentration, the amount of the surfactant, it is possible to prevent the aggregated particles from aggregating and coalescing together.

After the completion of the fusion process, particles are washed and dried to obtain toner particles. In view of the charging property of the toner, it is preferable to perform replace washing with ion exchange water. In general, the degree of washing is monitored by measuring the conductivity of the filtrate. It is preferable to make the conductivity finally to 25 μS/cm or lower. The washing may contain a process of neutralizing ions with an acid or a base. As for the treatment with an acid, it is preferable to adjust the pH to 4.0 or less, whereas as for the treatment with a base, it is preferable to adjust the pH to 8.0 or more. While there are no particular limitations with regard to solid-liquid separation after the washing, suction filtration, and pressure filtration such as filter press are preferably used from the viewpoint of productivity. Moreover, while there are no particular limitations also with regard to drying, freeze drying, flash jet drying, fluidized drying, and vibration type fluidized drying are preferably used from the viewpoint of productivity. The drying is performed so that the final water content will become 1% by weight or less, preferably 0.7% by weight or less.

To the toner particles obtained in the manner mentioned above, inorganic particles and organic particles as a fluid assistant, a cleaning assistant, an abrasive may be externally added. Examples of the inorganic particles include all particles which are usually used as an external additive to toner surfaces, such as silica, alumina, titanium oxide, calcium carbonate, magnesium carbonate, tricalcium phosphate and cerium oxide. Such inorganic particles are preferably particles with hydrophobized surfaces and are used for controlling toner properties such as charging property, powder property and preservability, and system fitness such as developability and transferability. Examples of the organic particles include all particles which are usually used as an external additive to toner surfaces, e.g. vinyl resins such as styrene type polymers, (meth)acrylic polymers, polymer of ethylene series, polyester resins, silicone resins and fluorocarbon resins.

Such particles are added in order to improve the transferability, and the primary particle diameter thereof is preferably from 0.01 μm to 0.5 μm. Furthermore, a lubricant may also be added. Examples of the lubricant include fatty acid amides such as ethylenebisstearylic amide and oleic amide, fatty acid metal salts such as zinc stearate and calcium stearate, and higher alcohols such as UNILIN. These are added generally for improving the cleaning property and those having a primary particle diameter of 0.5 μm to 8.0 μm are used.

It is preferable that two or more types of inorganic particles be used and that at least one type of the inorganic particles to be used have an average primary diameter of 30 nm to 200 nm, and more preferably 30 nm to 180 nm. Reduction in particle diameter of a toner will lead to increase in non-electrostatic adhesion force to a photoreceptor, which will cause defective transfer or image breakage which is called "hollow character". This will result in generation of transfer unevenness in superimposed images. Therefore, it is preferable to add an external additive having a large average primary diameter of 30 nm to 200 nm to improve the transferability. If the average primary particle diameter is smaller than 30 nm, while the initial fluidity of the toner is good, the non-electrostatic adhesion force between the toner and the photoreceptor can not be reduced and therefore the transfer efficiency will decrease to cause omission of images or unevenness of image density. Furthermore, particles are buried under the toner surface due to stress applied with time in a developing machine, resulting in variation of charging property. This may cause problems such as decrease in density and fogging to the background. On the other hand, if the average primary particle diameter is larger than 200 nm, particles are prone to come off from toner surfaces and this may lead to deterioration of fluidity.

Specifically, silica, alumina and titanium oxide are preferred, and in particular it is preferable to add hydrophobized silica as an essential ingredient. Especially, it is preferable to use silica and titanium oxide in combination. It is also preferable to use organic particles having a particle diameter of 80 mm to 500 mm together for the purpose of improvement in transferability. The hydrophobizer for hydrophobizing external additives include known materials, such as coupling agents, e.g. silane coupling agents, titanate coupling agents, aluminate coupling agents and zirconium coupling agents, silicone oil and polymer coating treatment.

The external additives are adhered or fixed to toner surfaces by application of mechanical impulsive force with a sample mill, a Henschel mixer.

(Toner Property)

The number average particle diameter of the toner of the exemplary embodiment is preferably within a range of 3 μm to 8 μm, more preferably within a range of 3.5 μm to 7.5 μm, and even more preferably within a range of 5 μm to 8 μm. If the number average particle diameter is smaller than 3 μm, the toner fluidity will deteriorate and the charging property of each particle is prone to deteriorate and the charging distribution will be broadened. Therefore, fogging to the background or leakage of a toner from a developing machine will occur easily. Moreover, if the number average particle diameter is smaller than 3 μm, it may become remarkably difficult to perform cleaning. If the number average particle diameter is larger than 8 μm, the resolution will lower, resulting in failure to obtain sufficient image quality. As a result, it may become difficult to satisfy the recent demand for high image quality.

The toner of the exemplary embodiment is preferably in a shape specified by an average of the circularity (average circularity) within a range of 0.940 to 0.980. When the toner is in a spherical shape characterized by an average circularity which is within this a range, the transfer efficiency and the minuteness of images are improved, so that high-quality image formation can be performed.

The measurements of the number average particle diameter and the average circularity are conducted using an FPIA3000 manufactured by Sysmex Corporation.

<Electrostatic Charge Image Developer>

The toner for electrostatic charge image development of an exemplary embodiment is used as it is as a one-component developer, or as a two-component developer. When used as a two-component developer, the toner is used in combination with a carrier.

The carrier which may be used for the two-component developer is not particularly limited, and known carriers may be used. Examples thereof include magnetic metals such as iron oxide, nickel, or cobalt, magnetic oxides such as ferrite or magnetite, resin-coated carriers comprising one of these substances as a core material having a resin coating layer on the surface thereof, and magnetic dispersed carriers. Further, the carrier may be of resin dispersion type in which an electrically conductive material or the like is dispersed in a matrix resin.

Examples of the coating resin and the matrix resin used for the carrier include, but not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid copolymer, straight silicone resin containing an organosiloxane bond or modified products thereof, fluorocarbon resin, polyester, polycarbonate, phenol resin, and epoxy resin.

Examples of the electrically conductive material include, but not limited to, metals such as gold, silver, or copper, carbon black, as well as titanium oxide, zinc oxide, barium sulfate, aluminum borate, potassium titanate, and tin oxide.

Examples of the core material of the carrier include magnetic metals such as iron, nickel, or cobalt, magnetic oxides such as ferrite or magnetite, and glass beads. For using a carrier in a magnetic brush method, the core material thereof is preferably a magnetic material. The volume average particle size of the core material for the carrier is commonly in a range of 10 μm to 500 μm and preferably in a range of 30 μm to 100 μm.

Further, examples of the method for resin-coating the surface of the core material of the carrier include a method of coating the core material with a solution for forming a coating layer in which the above coating resin and, as needed, various additives have been dissolved in an appropriate solvent. The solvent is not particularly limited, and may be selected according to the type, application property and the like of the coating resin to be used.

Specific examples of the resin coating method include a dipping method in which the core material of the carrier is dipped in a solution for forming a coating layer, a spray method in which a solution for forming a coating layer is sprayed on the surface of the core material of the carrier, a fluid bed method in which a solution for forming a coating layer is sprayed on the surface of the core material of the carrier which is suspended by flowing air, and a kneader coater method in which the core material of the carrier is mixed with a solution for forming a coating layer in a kneader coater, subsequently the solvent is removed.

In the above-described two-component developer, the mixing ratio (by weight) between the toner of an exemplary embodiment and the carrier is preferably roughly in a range of toner:carrier=1:100 to 30:100, and more preferably roughly in a range of 3:100 to 20:100.

<Image Forming Apparatus>

In the next place, the image forming apparatus of an exemplary embodiment using the above described toner for electrostatic charge image development of an exemplary embodiment is described.

The image forming apparatus of an exemplary embodiment includes an image holding member, a developing part that develops an electrostatic charge image formed on the image holding member into a toner image by a developer, a transfer part that transfers the toner image formed on the image holding member to a transfer-receiving body, and a fixing part that fixes the toner image transferred to the transfer-receiving body. As the developer, the electrostatic charge image developer of an exemplary embodiment is used.

In the image forming apparatus, for example, the portion including the developing part may have a cartridge structure (process cartridge) which is detachable from the main body of the image forming apparatus. As the process cartridge, the process cartridge of an exemplary embodiment which at least includes a developer holding member and contains the electrostatic charge image developer is preferably used.

An example of the image forming apparatus of an exemplary embodiment is illustrated below, but not limited thereto. Explanations are given only for main parts represented in the figures, and those for other parts are omitted.

In FIG. 1 and FIG. 2, 1Y, 1M, 1C, 1K, and 107 are each a photoreceptor (image holding member). 2Y, 2M, 2C, 2K, and 108 are each a charging roller. 3Y, 3M, 3C and 3K are each a laser beam. 3 is an exposure device. 4Y, 4M, 4C, 4K and 111 are each a development device (developing part). 5Y, 5M, 5C, and 5K are each a primary transfer roller. 6Y, 6M, 6C, 6K, and 113 are each a photoreceptor cleaning apparatus (cleaning part). 8Y, 8M, 8C, and 8K are each a toner cartridge. 10Y 10M, 10C and 10K are each a unit. 20 is an intermediate transfer belt. 22 is a driving roller. 24 is a supporting roller. 26 is a secondary transfer roller (transfer part). 28 and 115 are each a fixing device (fixing part). 30 is an intermediate transfer-receiving body cleaning device. 112 is a transfer device. 116 is a mounting rail. 117 is an opening for discharging exposure. 118 is an opening for exposure. 200 is a process cartridge. P and 300 are each a recording paper (transfer-receiving body).

FIG. 1 is a schematic block diagram showing a full color image forming apparatus of a train-of-four tandem type. The image forming apparatus shown in FIG. 1 includes first to fourth image forming units 10, 10M, 10C, and 10K of electrophotographic type (image forming part) for outputting images of yellow (Y), magenta (M), cyan (C), and black (K), respectively, on the basis of the color-separated image data. These image forming units (hereinafter simply referred to as "units") 10Y, 10M, 10C, and 10K are arranged in parallel in the horizontal direction at a predetermined distance apart from each other. These units 10Y, 10M, 10C, and 10K may be process cartridges which are detachable from the main body of the image forming apparatus.

An intermediate transfer belt 20 as an intermediate transfer-receiving body is extended in the superior region of the drawing of the units 10Y 10M, 10C, and 10K through the units. The intermediate transfer belt 20 is wound around a driving roller 22 and a supporting roller 24 in contact with the inner surface of the intermediate transfer belt 20, the rollers being arranged apart from each other in the horizontal direction from left to right in the figure, in such a manner that the belt travels in the direction from the first unit 10Y to the fourth unit 10K. The supporting roller 24 is biased by a spring or the like (not shown) in a direction away from the driving roller 22, and a predetermined tension is applied to the intermediate transfer belt 20 wound around these rollers. An intermediate transfer-receiving body cleaning device 30 is provided on the side of the image holding member of the intermediate transfer belt 20 opposite to the driving roller 22.

Further, four color toners of yellow, magenta, cyan, and black toners contained in the toner cartridges 8Y, 8M, 8C, and 8K can be supplied to the development device (developing part) 4Y, 4M, 4C, and 4K of the units10Y, 10M, 10C, and 10K, respectively.

Since the above first to fourth units 10Y, 10M, 10C, and 10K have an equivalent structure, the first unit 10Y for forming a yellow image arranged on the upstream side in the traveling direction of the intermediate transfer belt is described as a typical example. Descriptions of the second to fourth units 10M, 10C, and 10K are omitted by assigning the same reference numerals as the first unit 10Y to the corresponding parts, wherein the numerals are followed by magenta (M), cyan (C), or black (K) in place of yellow (Y).

The first unit 10Y has a photoreceptor 1Y which works as an image holding member. Around the photoreceptor 1Y, a charging roller 2Y that charges the surface of the photoreceptor 1Y to a predetermined potential, an exposure device 3 that exposes the charged surface to a laser beam 3Y based on the color-separated image signals to form an electrostatic charge image, a development device (developing part) 4Y that supply a charged toner to the electrostatic charge image to develop the electrostatic charge image, a primary transfer roller (primary transfer part) 5Y that transfers the developed toner image onto the intermediate transfer belt 20, and a photoreceptor cleaning device (cleaning part) 6Y that removes the toner remaining on the surface of the photoreceptor 1Y after primary transfer are arranged in this order.

The primary transfer roller 5Y is arranged inside of the intermediate transfer belt 20 at a position opposed to the photoreceptor 1Y. Further, bias power supplies (not shown) for applying primary transfer bias are connected respectively to each of the primary transfer rollers 5Y, 5M, 5C, and 5K. The bias power supplies are controlled by a control part (not shown) to vary the transfer bias to be applied to the primary transfer rollers.

The operation of forming a yellow image in the first unit 10Y is described below. In the first place, prior to the operation, the surface of the photoreceptor 1Y is charged to a potential of about −600V to about −800V by the charging roller 2Y.

The photoreceptor 1Y includes an electrically conductive substrate (volume resistivity at 20° C.: $1\times10^{-6}$ Ωcm or less) and a photosensitive layer disposed on the electrically conductive substrate. The photosensitive layer normally has high resistance (resistance equivalent to that of common resins), and has the property of changing the specific resistance of the portion irradiated with the laser beam 3Y. On this account, the laser beam 3Y is emitted to the surface of the charged photoreceptor 1Y via an exposure device 3 according to the image data for yellow transmitted from the control part (not shown). The laser beam 3Y is irradiated to the photosensitive layer on the surface of the photoreceptor 1Y, thereby to form an electrostatic charge image of yellow printing pattern on the surface of the photoreceptor 1Y.

An electrostatic charge image is an image formed on the surface of the photoreceptor 1Y by charging, and is a so-called negative latent image formed as follows: irradiation with the laser beam 3Y decreases the specific resistance of the irradiated portion in the photosensitive layer in the irradiated area, thereby allowing the charges on the surface of the photoreceptor 1Y to pass through, while charges remain in the portion which has not irradiated with the laser beam 3Y to form an image.

The electrostatic charge image formed on the photoreceptor 1Y as described above is rotated to the predetermined development position along with the traveling of the photoreceptor 1Y. Then, at the development position, the electrostatic charge image on the photoreceptor 1Y is developed into a visible image (developed image) by the development device 4Y.

The development device 4Y contains, for example, a yellow toner having a volume average particle size of 7 μm which at least contains a yellow colorant, a crystalline resin, and a non-crystalline resin. The yellow toner is friction-charged by being stirred in the development device 4Y to have an electric charge having the same polarity (negative polarity) as that of the electrified charge on the photoreceptor 1Y, and is held on the developer roll (developer holding member). Then the surface of the photoreceptor 1Y passes through the development device 4Y, thereby to adhere the yellow toner electrostatically to the discharged latent image portion on the surface of the photoreceptor 1Y, and the latent image is developed by the yellow toner. The photoreceptor 1Y formed with the yellow toner image keeps traveling at a predetermined rate, and the toner image developed on the photoreceptor 1Y is carried to a predetermined primary transfer position.

When the yellow toner image on the photoreceptor 1Y is carried to the primary transfer position, a predetermined primary transfer bias is applied to a primary transfer roller 5Y, and an electrostatic force from the photoreceptor 1Y toward the primary transfer roller 5Y is exerted on the toner image, thereby to transfer the toner image on the photoreceptor 1Y onto the intermediate transfer belt 20. The applied transfer bias has a positive polarity opposite to the negative polarity of the toner, and for example, in the first unit 10Y, the bias is controlled by the control part (not shown) to about +10 μA.

On the other hand, the toner remaining on the photoreceptor 1Y is removed and recovered by a cleaning device 6Y.

Further, the primary transfer bias applied to primary transfer rollers 5M, 5C, and 5K in the second unit 10M and afterward is also controlled according to the first unit.

Then, the intermediate transfer belt 20 onto which the yellow toner image has been transferred by the first unit 10Y is sequentially carried through the second to fourth units 10M, 10C, and 10K, and the toner images of each color are overlaid and transferred as multi-layers.

The intermediate transfer belt 20 onto which a four color toner image is transferred as the multi-layers through the first to fourth units comes to a secondary transfer part, which is constituted by the intermediate transfer belt 20, the supporting roller 24 in contact with the inner surface of the intermediate transfer belt 20, and a secondary transfer roller (secondary transfer part) 26 arranged on an image holding side of the intermediate transfer belt 20. On the other hand, a recording paper (transfer-receiving body) P is fed at a predetermined timing via a feeding mechanism to the gap where the secondary transfer roller 26 and the intermediate transfer belt 20 are brought into contact under pressure, and a predetermined secondary transfer bias is applied to the supporting roller 24.

At this time, the applied transfer bias has the same polarity (−) as the polarity of the toner (−), thereby an electrostatic force from the intermediate transfer belt 20 toward the recording paper P is exerted on the toner image, and the toner image on the intermediate transfer belt 20 is transferred onto the recording paper P. The secondary transfer bias is determined according to the resistance detected by a resistance detection part (not shown) for detecting the resistance of the secondary transfer part, and is subjected to voltage control.

Subsequently, the recording paper P is sent to a fixing device (fixing part) 28, the toner image is heated, and the toner image in which colors are layered is melted and fixed on the recording paper P. The recording paper P on which the fixing of the color image has been completed is carried toward an ejection part, thus a series of steps for forming a color image is finished.

The image forming apparatus exemplified above has a structure in which a toner image is transferred to the recording paper P via the intermediate transfer belt 20, but is not limited to the structure, and may have a structure in which a toner image is transferred to a recording paper directly from the photoreceptor.

As described previously, the toner contained in the developer used in the image forming apparatus of the exemplary embodiment is characterized in that it is excellent in highlight reproducibility and density reproducibility even if print is conducted at a relatively high speed under high temperature and high humidity environment. Therefore, it is possible to achieve stable image formation even if the process speed is increased to some extent. Specifically, the process speed may be increased to 300 mm/sec or higher, and moreover it may be increased to 350 mm/sec or higher.

<Process Cartridge, and Toner Cartridge>

Figure 2:
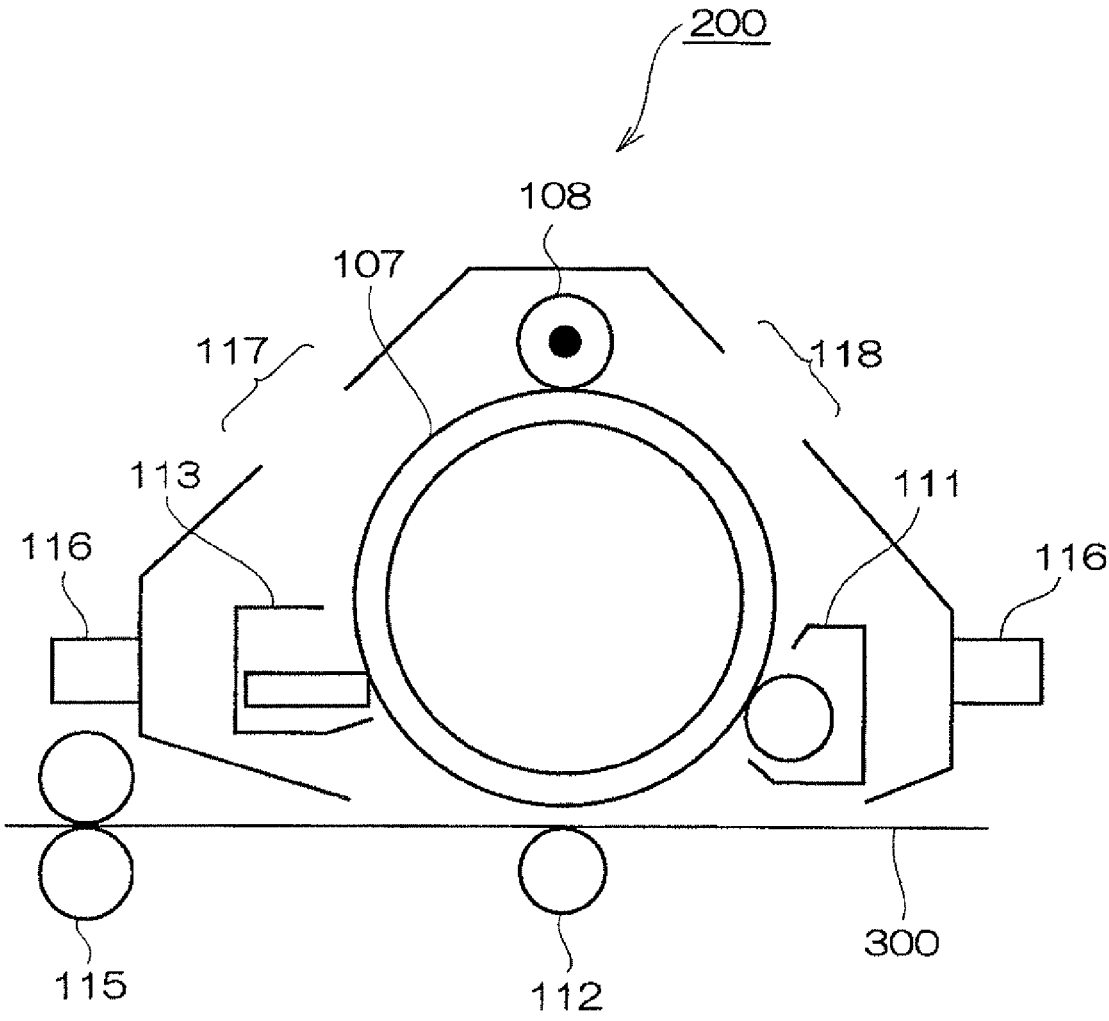
FIG. 2 is a schematic constitutional diagram which illustrates one example of a process cartridge of an exemplary embodiment.

FIG. 2 is a schematic block diagram showing a preferable example of the process cartridge which contains the electrostatic charge image developer of the exemplary embodiment. A process cartridge 200 includes a photoreceptor 107, a charging roller 108, a development device 111, a photoreceptor cleaning device (cleaning part) 113, an opening 118 for exposure, and an opening 117 for discharging exposure and these are integrated as a unit using a mounting rail 116.

The process cartridge 200 is detachable from the main body of the image forming apparatus including a transfer device 112, a fixing device 115, and other components (not shown), and serves as a part of the image forming apparatus together with the main body of image forming apparatus. The numeral 300 represents a recording paper.

The process cartridge shown in FIG. 2 includes a charging device 108, a development device 111, a cleaning device (cleaning part) 113, and an opening 118 for exposure, and an opening 117 for discharging exposure. These devices may be selectively combined. The process cartridge of the exemplary embodiment of the invention includes, in addition to the photoreceptor 107, at least one selected from the group consisting of the charging device 108, the development device 111, the cleaning device (cleaning part) 113, opening 118 for exposure, and opening 117 for discharging exposure.

In the next place, the toner cartridge of the exemplary embodiment is further described. The toner cartridge of the exemplary embodiment is detachably placed in the image forming apparatus, wherein at least in the toner cartridge which contains the toner to be fed to the developing part provided in the above image forming apparatus, the toner is the toner of an exemplary embodiment of the invention as already mentioned. The toner cartridge of an exemplary embodiment of the invention may be any toner cartridge as long as it contains at least a toner, and may contain, for example, a developer, depending on the mechanism of the image forming apparatus.

Accordingly, in an image forming apparatus having a structure in which a toner cartridge is detachable, the use of a toner cartridge containing the toner of an exemplary embodiment of the invention can allow to maintain storability even in the toner cartridge which is especially miniaturized, and can attain low temperature fixation while a high quality image is being maintained.

The image forming apparatus shown in FIG. 1 is an image forming apparatus having a structure in which the toner cartridges 8Y, 8M, 8C, and 8K are detachable, and the development devices 4Y, 4M, 4C, and 4K are respectively connected to the toner cartridges corresponding to each development device (color) through toner feeding pipes (not shown). Further, when the toner contained in the toner cartridge draws to an end, the toner cartridge can be replaced.

EXAMPLES

The present invention will be illustrated in detail by the following Examples and Comparative Examples. However, the invention is not limited to the following Examples. Unless otherwise noted, "part" refers to "part by weight", and "%" refers to "% by weight".

<Measuring Methods for Various Properties>

In the first place, the methods for determining the physical properties of the toner and others used in Examples and Comparative Examples (except for the above-mentioned method) are described.

(Measuring Method of Molecular Weight and Molecular Weight Distribution of Resin)

In the Examples, the molecular weight and molecular weight distribution of the crystalline polyester resin and others are determined under the following conditions. GPC is carried out with an "HLC-8120GPC, SC-8020 (manufactured by Tosoh Corporation) apparatus", two columns, "TSK gel, Super HM-H (6.0 mm inner diameter×15 cm, manufactured by Tosoh Corporation)", and THF (tetrahydrofuran) as an eluate. The experiment is carried out using an IR detector under the following experimental conditions: sample concentration of 0.5%, flow rate of 0.6 ml/min, sample injection amount of 10 μl, and determination temperature of 40° C. Further, a calibration curve is prepared from 10 samples of "Polystyrene Standard Sample TSK Standard": "A-500", "F-1", "F-10", "F-80", "F-380", "A-2500", "F-4", "F-40", "F-128", and "F-700" (manufactured by Tosoh Corporation).

The interval for collecting the data in the sample analysis is 300 ms. (Volume Average Particle Diameter of Composite Particles, Releasing agent Particles, and Others)

Each of the volume average particle diameter of the composite particles, releasing agent particles, and others is determined with a laser diffraction particle size measuring machine (LA-700, manufactured by Horiba, Ltd.).

(Melting Temperatures of Crystalline Resin and Releasing Agent)

The melting temperature temperatures (Tm) of the crystalline resin and a releasing agent are measured in accordance with ASTM D3418-8 using a differential scanning calorimeter (trade name: DSC60, manufactured by Shimadzu Corporation, with an automatic tangent processing system) at a temperature rising rate of 10° C./min from 25° C. to 150° C. The peak temperature of an endothermic peak is used as a melting temperature.

<Synthesis of Resins>

(Crystalline Polyester Resin (1))

To a three-necked flask having been dried by heating, an acid component composed of 100 mol % of dimethyl sebacate and an alcohol component composed of 100 mol % of butanediol are charged in a molar ratio of 1:1, and then, to 100 parts of these components, 0.3 parts of dibutyltin oxide is charged as a catalyst. Thereafter, the air inside the flask is replaced to an inert atmosphere with nitrogen gas by pressure reduction operation, followed by stirring and refluxing at 185° C. for 6 hours by mechanical stirring. During the reaction, water generated in the system is distilled off. Then, the temperature is gradually elevated to 220° C. under reduced pressure, followed by stirring for 2 hours. When the mixture becomes viscous, it is air-cooled to stop the reaction. Thus, crystalline polyester resin (1) is synthesized.

Molecular weight measurement by gel permeation chromatography (in terms of polystyrene) reveals that the weight average molecular weight (Mw) of the obtained crystalline polyester resin (1) is 25,000. When the melting temperature (Tm) of the crystalline polyester resin (1) is measured, a clear endothermic peak is shown and the endothermic peak temperature is 70.3° C.

(Non-Crystalline Polyester Resin (1))

To a three-necked flask having been dried by heating, an alcohol component composed of 50 mol % of bisphenol A-propylene oxide adduct and 50 mol % of bisphenol A-ethylene oxide adduct and an acid component composed of 75 mol % fumaric acid and 25 mol % of terephthalic acid are charged in a molar ratio of 1:1, and then the temperature is elevated from room temperature to 190° C. over 1 hour and inside the reaction system is stirred uniformly. Then, to 100 parts of these components, 1.2 parts of dibutyltin oxide is charged as a catalyst. While water generated in the reaction system is distilled off, the temperature is elevated from 195° C. to 245° C. over 6 hours, and dehydration condensation is continued for additional 2 hours at 245° C. Thereafter, air-cooling is performed to stop the reaction. Thus, non-crystalline polyester resin (1) is synthesized.

Molecular weight measurement by gel permeation chromatography (in terms of polystyrene) reveals that the weight average molecular weight (Mw) of the obtained non-crystalline polyester resin (1) is 49,000.

(Non-Crystalline Polyester Resin (2))

To a three-necked flask having been dried by heating, an alcohol component composed of 60 mol % of bisphenol A-propylene oxide adduct, 20 mol % of bisphenol A-ethylene oxide adduct and 20 mol % of cyclohexanedimethanol and an acid component composed of 15 mol % dodecenylsuccinic acid, 50 mol % of terephthalic acid and 35 mol % of dodecanedioic acid are charged in a molar ratio of 1:1, and then the temperature is elevated from room temperature to 190° C. over 1 hour and inside the reaction system is stirred uniformly. Then, to 100 parts of these components, 1.2 parts of dibutyltin oxide is charged as a catalyst. While water generated in the reaction system is distilled off, the temperature is elevated from 190° C. to 240° C. over 6 hours and dehydration condensation is continued for additional 3 hours at 240° C. Thereafter, air-cooling is performed to stop the reaction. Thus, non-crystalline polyester resin (2) is synthesized.

Molecular weight measurement by gel permeation chromatography (in terms of polystyrene) reveals that the weight average molecular weight (Mw) of the obtained non-crystalline polyester resin (2) is 16,000.

<Preparation of Dispersions>

(Composite Particle Dispersion (1))

56 parts of the non-crystalline polyester resin (2), 14 parts of a cyan colorant (cyan pigment, copper phthalocyanine B15:3, produced by Dainichiseika Color & Chemicals Mfg. Co., Ltd.), 380 parts of isopropyl acetate, and 6 parts of an anionic surfactant (trade name: NEOGEN RK, produced by Dai-Ichi Kogyo Seiyaku Co., Ltd.) are prepared. They are charged into a stainless steel beaker and the beaker is put in a hot bath to be heated to 80° C. When the resin in the beaker has melted, the beaker is stirred at 8000 rpm using a homogenizer (trade name: ULTRA-TURRAX T50, manufactured by IKA) at 8000 rpm and 544 parts of ion exchange water is added, followed by emulsification dispersion. Then, the solvent is removed by unit of a rotary evaporator to obtain composite particles composed of the non-crystalline polyester resin (2) and the cyan colorant, and thereby a composite particle dispersion (1) including the composite particles having a volume average particle diameter of 280 nm is obtained. The solid content of the composite particles in the dispersion is adjusted to be 10% by adding ion exchange water.

(Composite Particle Dispersion (2))

20 parts of the crystalline polyester resin (1), 60 parts of a non-crystalline polyester resin (2), 20 parts of a cyan colorant (cyan pigment, copper phthalocyanine B15:3, produced by Dainichiseika Color & Chemicals Mfg. Co., Ltd.), 50 parts of methyl ethyl ketone, and 15 parts of isopropyl alcohol are charged into a three-necked flask, and the resin is dissolved by heating to 60° C. while stirring. Then, 25 parts of 10% aqueous ammonium solution is added and further 400 parts of ion exchange water is gradually added to cause phase inversion emulsification. By removing the solvent, composite particles composed of the crystalline polyester resin (1), the non-crystalline polyester resin (2) and the cyan colorant are formed and a composite particle dispersion (2) including the composite particles having a volume average particle diameter of 200 nm is obtained. The solid content of the dispersion is adjusted to be 10% by adding ion exchange water.

(Resin Dispersion (1))

90 parts of a crystalline polyester resin (1), 1.8 parts of an ionic surfactant (trade name: NEOGEN RK, produced by Dai-Ichi Kogyo Seiyaku Co., Ltd.), and 210 parts of ion exchange water 210 are prepared. These are mixed and the mixture is heated to 100° C. The resulting mixture is fully dispersed with a homogenizer (trade name: ULTRA-TURRAX T50, manufactured by IKA), followed by dispersion treatment for 2 hours by use of a pressure discharge-type Gaulin Homogenizer to obtain a resin dispersion (1) including resin particles having an volume average particle diameter of 220 nm. The solid content of the resin particles in the dispersion is adjusted to be 10% by adding ion exchange water.

(Resin Dispersion (2))

100 parts of a non-crystalline polyester resin (1), 50 parts of methyl ethyl ketone, and 20 parts of isopropyl alcohol are charged into a three-necked flask, and the resin is dissolved by heating to 40° C. while stirring. Then, 30 parts of 10% aqueous ammonium solution is added and further 400 parts of ion exchange water is gradually added to cause phase inversion emulsification. After the phase inversion emulsification is performed and the solvent is removed, and the solid content is adjusted to obtain, a resin dispersion (2) which includes resin particles having a volume average particle diameter of 180 nm and has a solid content of 10%.

(Resin Dispersion (3))

100 parts of a non-crystalline polyester resin (2), 40 parts of methyl ethyl ketone, and 25 parts of isopropyl alcohol are charged into a three-necked flask, and the resin is dissolved by heating to 35° C. while stirring. Then, 25 parts of 10% aqueous ammonium solution is added and further 400 parts of ion exchange water is gradually added to cause phase inversion emulsification. After the phase inversion emulsification is performed and the solvent is removed, and the solid content is adjusted to obtain, a resin dispersion (3) which includes resin particles having a volume average particle diameter of 170 nm and has a solid content of 10%.

(Releasing Agent Dispersion (1))

80 parts of an ester wax (trade name: WEP-4, produced by NOF Corporation, melting temperature: 72° C.), 1.0 part of an anionic surfactant (trade name: NEOGEN RK, produced by Dai-Ichi Kogyo Seiyaku Co., Ltd.), and 120 parts of ion exchange water are mixed and dissolved at 95° C. Then, dispersion is performed for 10 minutes in a round stainless steel flask by use of a homogenizer (trade name: ULTRA-TURRAX T50, manufactured by IKA), followed by dispersion treatment with a pressure discharge-type homogenizer. Thus, a releasing agent dispersion (1), in which releasing agent particles having a volume average particle diameter of 180 nm are dispersed, is prepared.

(Releasing Agent Dispersion (2))

80 parts of an paraffin wax (trade name: HNP51, produced by Nippon Seiro Co., Ltd., melting temperature: 77° C.), 1.0 part of an anionic surfactant (trade name: NEOGEN RK, produced by Dai-Ichi Kogyo Seiyaku Co., Ltd.), and 120 parts of ion exchange water are mixed and dissolved at 100° C. Then, dispersion is performed for 10 minutes in a round stainless steel flask by use of a homogenizer (trade name: ULTRA-TURRAX T50, manufactured by IKA), followed by dispersion treatment with a pressure discharge-type homogenizer. Thus, a releasing agent dispersion (2), in which releasing agent particles having a volume average particle diameter of 180 nm are dispersed, is prepared.

(Releasing Agent Dispersion (3))

80 parts of a microcrystalline wax (trade name: HI-MIC-1080, produced by Nippon Seiro Co., Ltd., melting temperature: 83° C.), 1.0 part of an anionic surfactant (trade name: NEOGEN RK, produced by Dai-Ichi Kogyo Seiyaku Co., Ltd.), and 120 parts of ion exchange water are mixed and dissolved at 95° C. Then, dispersion is performed for 10 minutes in a round stainless steel flask by use of a homogenizer (trade name: ULTRA-TURRAX T50, manufactured by IKA), followed by dispersion treatment with a pressure discharge-type homogenizer. Thus, a releasing agent dispersion (3), in which releasing agent particles having a volume average particle diameter of 180 nm are dispersed, is prepared.

(Releasing Agent Dispersion (4))

80 parts of an paraffin wax (trade name: HNP0190, produced by Nippon Seiro Co., Ltd., melting temperature: 89° C.), 1.0 part of an anionic surfactant (trade name: NEOGEN RK, produced by Dai-Ichi Kogyo Seiyaku Co., Ltd.), and 120 parts of ion exchange water are mixed and dissolved at 100° C. Then, dispersion is performed for 10 minutes in a round stainless steel flask by use of a homogenizer (trade name: ULTRA-TURRAX T50, manufactured by IKA), followed by dispersion treatment with a pressure discharge-type homogenizer. Thus, a releasing agent dispersion (4), in which releasing agent particles having a volume average particle diameter of 180 nm are dispersed.

(Releasing Agent Dispersion (5))

80 parts of a polyethylene wax (trade name: POLYWAX 725, produced by Toyo Petrolite Co. Ltd., melting temperature: 103° C.) 80 parts, 1.0 part of an anionic surfactant (trade name: NEOGEN RK, produced by Dai-Ichi Kogyo Seiyaku Co., Ltd.), and 120 parts of ion exchange water are mixed and dissolved at 115° C. Then, dispersion is performed for 10 minutes in a round stainless steel flask by use of a homogenizer (trade name: ULTRA-TURRAX T50, manufactured by IKA), followed by dispersion treatment with a pressure discharge-type homogenizer. Thus, a releasing agent dispersion (5), in which releasing agent particles having a volume average particle diameter of 180 nm are dispersed, is prepared.

(Colorant Dispersion (1))

Cyan pigment (C. I. Pigment Blue 15:3 (copper phthalocyanine), produced by Dainichiseika Color & Chemicals Mfg. Co., Ltd.): 45 parts Ionic surfactant (trade name: NEOGEN RK, produced by Dai-Ichi Kogyo Seiyaku Co., Ltd.): 5 parts Ion exchange water: 200 parts The components shown above are mixed, dissolved and then dispersed for 10 minutes with a homogenizer (trade name: ULTRA-TURRAX T50, manufactured by IKA). Thereby, a colorant dispersion which includes colorant particles having a volume average particle diameter of 168 nm and has a solid content of 23.0% is obtained.

Example 1

(Production of Toner)

300 parts of the composite particle dispersion (2), 350 parts of the resin dispersion (2), and 50 parts of the releasing agent dispersion (2) are prepared and they are dispersed and mixed in a round stainless steel flask for 30 minutes using ULTRA-TURRAX T50 (manufactured by IKA) under a condition of 8,000 rpm, while adding a shear force. Then, 0.14 parts of a 10% aqueous nitric acid solution of polyaluminum chloride is prepared. While dropping this solution into the above container to accelerate the aggregation of the composite particles, the resin particles and the releasing agent particles in the dispersion, the temperature is elevated to 47° C. over 200 minutes and then is held for 100 minutes while stirring the flask in an oil bath for heating. 300 parts of the resin dispersion (2) is added at 47° C. and then is left at rest for 30 minutes. Thereafter, 3 parts of an anionic surfactant (trade name: NEOGEN RK, produced by Dai-Ichi Kogyo Seiyaku Co., Ltd.) is added and the stainless steel flask is closed hermetically. While continuing agitation with a magnetic seal, the mixture is heated to 70° C. and is held at 70° C. for 13 hours. Then, toner particles (A) are obtained by performing cooling at a cooling rate of 10° C./min, filtration, full washing with ion exchange water, and drying.

The toner particles (A) obtained have a number average particle diameter of 5.11 μm and an average circularity of 0.961. When content ratios at a particle diameter distribution/circularity distribution by the above-described method are checked, the content ratio of particles having a number particle diameter of 4.5 μm or more and less than 7.5 μm and a circularity of 0.980 or more (henceforth, referred to as "M ratio") is 9 number %, and the content ratio of particles having a number particle diameter of 7.5 μm or more and less than 15 μm and a circularity degree of 0.900 or more and less than 0.940 (henceforth, referred to as "L rate") is 2 number %.

To 100 parts of the obtained toner particles (A), 1 part of silica (trade name: R972, produced by Nippon Aerosil Co., Ltd.) is added and mix-blended using a Henschel mixer to yield a toner A with silica externally added.

(Production of Electrostatic Charge Image Developer)

A coating agent resin solution prepared by adding and stirring 1.25 parts of a 80% ethyl acetate solution of trifunctional isocyanate (trade name: TAKENATE D110N, produced by Takeda Pharmaceutical Co., Ltd.) to a carbon dispersion obtained by mixing 0.10 parts of carbon black (trade name: VXC-72, produced by Cabot Corporation) to 1.25 parts of toluene and subjecting stirring dispersion using a sand mill for 20 minutes, and Mn—Mg—Sr ferrite particles (volume average particle diameter: 35 μm) are charged into a kneader, followed by mixing and stirring at 25° C. for 5 minutes. Then, the temperature is elevated to 150° C. under normal pressure to evaporate the solvent. After mix-agitation for 30 minutes, the heater is turned off to lower the temperature to 50° C. The resulting coated carrier is screened through a 75-μm mesh to prepare a carrier.

By mixing 95 parts of this carrier and 5 parts of the toner A with a V blender, a developer A is obtained.

(Evaluation)

The obtained developer A is mounted in a developing device of a modified machine of Docu Centre C7550 (manufactured by Fuji Xerox Co., Ltd.) (process speed: 320 mm/sec, preset temperature of the fixing device: 160° C.), and 1,000-sheet continuous print is performed under an environment of 32° C. and 90% RH.

-Tone Reproducibility-

In evaluation, tone image signals are transmitted to an apparatus with graded print densities from 1% to 25% in terms of image signal density (Cin) for every predetermined area. Then, for each portion with an individual density of the output tone chart, the density is measured in order from the highest density using an image density meter X-rite 404 (manufactured by X-rite Co., Ltd.). A signal density which corresponds to a portion where the measured density difference between a non-image portion (background) and an image portion is 0 (zero) is determined as a "tone reproduction limit area ratio". The smaller the area ratio is, the better the tone reproducibility is. Evaluation is conducted in light of the following criteria.

A: The tone reproduction limit area ratio is less than 5%.

B: The tone reproduction limit area ratio is 5% or more and less than 10%.

C: The tone reproduction limit area ratio is 10% or more and less than 15%.

D: The tone reproduction limit area ratio is 15% or more.

Results are shown in Table 1.

-Density Unevenness-

A solid image sized 10 cm×5 cm is output and the image density after 10-sheet continuous printing is measured with an X-rite 404. The image density is measured randomly at 10 temperatures and the difference between the maximum value and the minimum value is determined, followed by evaluation using the criteria given below.

A: The image density difference is less than 0.05.

B: The image density difference is 0.05 or more and less than 0.10.

C: The image density difference is 0.10 or more and less than 0.15.

D: The image density difference is 0.15 or more.

Results are shown in Table 1.

-In-Machine Stain-

The condition of the occurrence of cloud in a machine after 10,000-sheet printing is evaluated in light of the criteria given below by measuring the amount of scattering toner (average value during the 10,000-sheet printing) in the machine using a DustTrak Model 13451 manufactured by KANOMAX JAPAN, Inc.

A: The number of scattering toner is less than 5 particles/$cm^3$.

B: The number of scattering toner is 5 particles/$cm^3$ or more and less than 20 particles/$cm^3$.

C: The number of scattering toner is 20 particles/$cm^3$ or more.

Results are shown in Table 1.

Example 2

300 parts of the composite particle dispersion (2), 200 parts of the resin dispersion (2), 130 parts of the resin dispersion (3), and 70 parts of the releasing agent dispersion (3) are prepared and they are dispersed and mixed in a round stainless steel flask for 30 minutes, while adding a shear force, using an ULTRA-TURRAX T50 (manufactured by IKA) under a condition of 8,000 rpm. Then, 0.14 parts of a 10% aqueous nitric acid solution of polyaluminum chloride is prepared. While dropping this solution into the above container to accelerate the aggregation of the composite particles, the resin particles and the releasing agent particles in the dispersion, mixing and dispersions are conducted, and then the temperature is elevated up to 49° C. over 200 minutes and then is held for 100 minutes while stirring the flask in an oil bath for heating. 300 parts of the resin dispersion (3) is added at 49° C. and then is left at rest for 20 minutes. Thereafter, 3 parts of an anionic surfactant (trade name: NEOGEN RK, produced by Dai-Ichi Kogyo Seiyaku Co., Ltd.) is added, and the stainless steel flask is closed hermetically.

While continuing agitation with a magnetic seal, the mixture is heated to 73° C. and is held at 73° C. for 10 hours. Then, toner particles (B) are obtained by performing cooling at a cooling rate of 10° C./min, filtration, fill washing with ion exchange water, and drying.

An external additive treatment is applied to the toner particles (B) in a similar manner to that in Example 1 to obtain toner B. Then, evaluations similar to those of Example 1 are conducted by using the toner B as a developer.

Results are shown in Table 1 together with the properties of the toner B.

Example 3

250 parts of the composite particle dispersion (2), 430 parts of the resin dispersion (2), and 70 parts of the releasing agent dispersion (4) are prepared and they are dispersed and mixed in a round stainless steel flask for 30 minutes, while adding a shear force, using an ULTRA-TURRAX T50 (manufactured by IKA) under a condition of 8,000 rpm. Then, 0.16 parts of a 10% aqueous nitric acid solution of polyaluminum chloride is prepared. While dropping this solution into the above container to accelerate the aggregation of the composite particles, the resin particles and the releasing agent particles in the dispersion, mixing and dispersions are conducted, and then the temperature is elevated to 53° C. over 150 minutes and then is held for 200 minutes while stirring the mixture inside the flask in an oil bath for heating. 250 parts of the resin dispersion (2) is added at 53° C. and then is left at rest for 200 minutes. Thereafter, 3 parts of an anionic surfactant (trade name: NEOGEN RK, produced by Dai-Ichi Kogyo Seiyaku Co., Ltd.) is added, and the stainless steel flask is closed hermetically. While continuing agitation with a magnetic seal, the mixture is heated to 80° C. and is held at 80° C. for 4 hours. Then, toner particles (C) are obtained by performing cooling at a cooling rate of 10° C./min, filtration, full washing with ion exchange water, and drying.

An external additive treatment is applied to the toner particles (C) in ta similar manner to that in Example 1 to obtain toner C. Then, evaluations similar to Example 1 are conducted by using the toner C as a developer.

Results are shown in Table 1 together with the properties of the toner C.

Example 4

300 parts of the composite particle dispersion (1), 100 parts of the resin dispersion (1), 100 parts of the resin dispersion (2), 100 parts of the resin dispersion (3), and 100 parts of the releasing agent dispersion (3) are prepared and they are dispersed and mixed in a round stainless steel flask for 30 minutes, while adding a shear force, using an ULTRA-TURRAX T50 (manufactured by IKA) under a condition of 8,000 rpm. Then, 0.15 parts of a 10% aqueous nitric acid solution of polyaluminum chloride is prepared. While dropping this solution into the above container to accelerate the aggregation of the composite particles, the resin particles and the releasing agent particles in the dispersion, mixing and dispersions are conducted, and then the temperature is elevated up to 48° C. over 180 minutes and then is held for 60 minutes while stirring the mixture inside the flask in an oil bath for heating. 300 parts of the resin dispersion (3) is added at 48° C. and then is left at rest for 60 minutes. Thereafter, 3 parts of an anionic surfactant (trade name: NEOGEN RK, produced by Dai-Ichi Kogyo Seiyaku Co., Ltd.) is added, and the stainless steel flask is closed hermetically. While continuing agitation with a magnetic seal, the mixture is heated to 77° C. and is held at 77° C. for 6 hours. Then, toner particles (D) are obtained by performing cooling at a cooling rate of 10° C./min, filtration, full washing with ion exchange water, and drying.

An external additive treatment is applied to the toner particles (D) in a similar manner to that in Example 1 to obtain toner D. Then, evaluations similar to those of Example 1 are conducted by using toner D as a developer.

Results are shown in Table 1 together with the properties of the toner D.

Example 5

200 parts of the composite particle dispersion (1), 200 parts of the resin dispersion (1), 330 parts of the resin dispersion (3), and 100 parts of the releasing agent dispersion (1) are prepared and they are dispersed and mixed in a round stainless steel flask for 30 minutes, while adding a shear force, using an ULTRA-TURRAX T50 (manufactured by IKA) under a condition of 8,000 rpm. Then, 0.15 parts of a 10% aqueous nitric acid solution of polyaluminum chloride is prepared. While dropping this solution into the above container to accelerate the aggregation of the composite particles, the resin particles and the releasing agent particles in the dispersion, mixing and dispersions are conducted, and then the temperature is elevated up to 50° C. over 120 minutes and then is held for 100 minutes while stirring the mixture inside the flask in an oil bath for heating. 200 parts of the resin dispersion (3) is added at 50° C. and then is left at rest for 10 minutes. Thereafter, the pH is adjusted to 8.5 by addition of sodium hydroxide, and the stainless steel flask is closed hermetically. While continuing agitation with a magnetic seal the mixture is heated to 66° C. and is held at 66° C. for 18 hours. Then, toner particles (E) are obtained by performing cooling at a cooling rate of 10° C./min, filtration, full washing with ion exchange water, and drying.

An external additive treatment is applied to the toner particles (E) in a similar manner to that in Example 1 to obtain toner E. Then, evaluations similar to those of Example 1 are conducted by using the toner E as a developer.

Results are shown in Table 1 together with the properties of the toner E.

Example 6

250 parts of the composite particle dispersion (1), 80 parts of the resin dispersion (1), 260 parts of the resin dispersion (2), and 50 parts of the releasing agent dispersion (5) are prepared and they are dispersed and mixed in a round stainless steel flask for 30 minutes, while adding a shear force, using an ULTRA-TURRAX T50 (manufactured by IKA) under a condition of 8,000 rpm. Then, 0.15 parts of a 10% aqueous nitric acid solution of polyaluminum chloride is prepared. While dropping this solution into the above container to accelerate the aggregation of the composite particles, the resin dispersion and the releasing agent particles in the dispersion, mixing and dispersions are conducted, and then the temperature is elevated up to 47° C. over 200 minutes and then is held for 60 minutes while stirring the mixture inside the flask in an oil bath for heating. 360 parts of the resin dispersion (3) is added at 47° C. and then is left at rest for 30 minutes. Thereafter, 3 parts of an anionic surfactant (trade name: NEOGEN RK, produced by Dai-Ichi Kogyo Seiyaku Co., Ltd.) is added, and the stainless steel flask is closed hermetically. While continuing agitation with a magnetic seal, the temperature is increased to 97° C. and is held at 97° C. for 2 hours. Then, toner particles (F) are obtained by performing cooling at a cooling rate of 10° C./min, filtration, full washing with ion exchange water, and drying.

An external additive treatment is applied to the toner particles (F) in a similar manner to that in Example 1 to obtain toner F. Then, evaluations similar to those of Example 1 are conducted by using the toner F as a developer.

Results are shown in Table 1 together with the properties of the toner F.

Example 7

200 parts of the composite particle dispersion (1), 300 parts of the resin dispersion (2), 300 parts of the resin dispersion (3), and 60 parts of the releasing agent dispersion (4) are prepared and they are dispersed and mixed in a round stainless steel flask for 30 minutes, while adding a shear force, using an ULTRA-TURRAX T50 (manufactured by IKA) under a condition of 8,000 rpm. Then, 0.15 parts of a solution of polyaluminum chloride in a 10% aqueous nitric acid solution is prepared. While dropping this solution into the above container to accelerate the aggregation of the composite particles, the resin particles and the releasing agent particles in the dispersion, mixing and dispersions are conducted, and then the mixture is heated up to 52° C. over 200 minutes and then is held for 100 minutes while stirring the mixture inside the flask in an oil bath for heating. 200 parts of the resin dispersion (2) is added at 52° C. and then is left at rest for 60 minutes. Thereafter, 3 parts of an anionic surfactant (trade name: NEOGEN RK, produced by Dai-Ichi Kogyo Seiyaku Co., Ltd.) is added and the stainless steel flask was closed hermetically. While continuing agitation with a magnetic seal, the temperature is increased to 84° C. and is held at 84° C. for 4 hours. Then, toner particles (G) are obtained by performing cooling at a cooling rate of 10° C./min, filtration, full washing with ion exchange water, and drying.

An external additive treatment is applied to the toner particles (G) in a similar manner to that in Example 1 to obtain toner G. Then, evaluations similar to as those of Example 1 are conducted by using the toner G as a developer. It is noted that this toner is evaluated for density unevenness/in-machine stain/tone reproducibility by setting the fixation temperature to 180° C.

Results are shown in Table 1 together with the properties of the toner G.

Comparative Example 1

40 parts of the resin dispersion (1), 400 parts of the resin dispersion (2), 200 parts of the resin dispersion (3), 60 parts of the colorant dispersion (1), and 100 parts of the releasing agent dispersion (5) are prepared and they are dispersed and mixed in a round stainless steel flask for 30 minutes, while adding a shear force, using an ULTRA-TURRAX T50 (manufactured by IKA) under a condition of 8,000 rpm. Then, 0.15 parts of a 10% aqueous nitric acid solution of polyaluminum chloride is prepared. While dropping this solution into the above container to accelerate the aggregation of the colorant particles, the resin particles and the releasing agent particles in the dispersion, mixing and dispersions are conducted, and then the mixture is elevated up to 51° C. over 100 minutes and then is held for 200 minutes while stirring the mixture inside the flask in an oil bath for heating. 200 parts of the resin dispersion (2) is added at 51° C. and then is left at rest for 30 minutes. Thereafter, 3 parts of an anionic surfactant (trade name: NEOGEN RK, produced by Dai-Ichi Kogyo Seiyaku Co., Ltd.) is added and the stainless steel flask was closed hermetically. While continuing agitation with a magnetic seal, the temperature is increased to 83° C. and is held at 83° C. for 2 hours. Then, toner particles (H) are obtained by performing cooling at a cooling rate of 10° C./min, filtration, full washing with ion exchange water, and drying.

An external additive treatment is applied to the toner particles (H) in a similar manner to that in Example 1 to obtain toner H. Then, evaluations similar to those of Example 1 are conducted by using the toner H as a developer.

Results are shown in Table 1 together with the properties of toner H.

Comparative Example 2

200 parts of the resin dispersion (1), 200 parts of the resin dispersion (2), 190 parts of the resin dispersion (3), 60 parts of the colorant dispersion (1), and 100 parts of the releasing agent dispersion (1) are prepared and they are dispersed and mixed in a round stainless steel flask for 30 minutes, while adding a shear force, using an ULTRA-TURRAX T50 (manufactured by IKA) under a condition of 8,000 rpm. Then, 0.15 parts of a 10% aqueous nitric acid solution of polyaluminum chloride is prepared. While dropping this solution into the container to accelerate the aggregation of the colorant particles, the resin particles and the releasing agent particles in the dispersion, mixing and dispersions are conducted, and then the mixture is heated up to 48° C. over 130 minutes and then is held for 100 minutes while stirring the mixture inside the flask in an oil bath for heating. 250 parts of the resin dispersion (3) is added at 48° C. and then is left at rest for 10 minutes. Thereafter, 3 parts of an anionic surfactant (trade name: NEOGEN RK, produced by Dai-Ichi Kogyo Seiyaku Co., Ltd.) is added and the stainless steel flask is closed hermetically. While continuing agitation with a magnetic seal, the temperature is increased to 92° C. and is held at 92° C. for 1 hour. Then, toner particles (I) are obtained by performing cooling at a cooling rate of 10° C./min, filtration, full washing with ion exchange water, and drying.

An external additive treatment is applied to the toner particles (I) in a similar manner to that in Example 1 to obtain toner I. Then, evaluations similar to those of Example 1 are conducted by using toner I as a developer.

Results are shown in Table 1 together with the properties of the toner I.

Comparative Example 3

100 parts of the resin dispersion (1), 300 parts of the resin dispersion (2), 210 parts of the resin dispersion (3), 40 parts of the colorant dispersion (1), and 50 parts of the releasing agent dispersion (1) are prepared and they are dispersed and mixed in a round stainless steel flask for 30 minutes, while adding a shear force, using an ULTRA-TURRAX T50 (manufactured by IKA) under a condition of 8,000 rpm. Then, 0.15 parts of a 10% aqueous nitric acid solution of polyaluminum chloride is prepared. While dropping this solution into the above container to accelerate the aggregation of the colorant particles, the resin particles in the diapersion and the releasing agent particles, mixing and dispersions are conducted, and then the mixture is heated up to 54° C. over 20 minutes and then is held for 30 minutes while stirring the mixture inside the flask in an oil bath for heating. 300 parts of the resin dispersion (3) is added at 54° C. and then is left at rest for 10 minutes. Thereafter, 3 parts of an anionic surfactant (trade name: NEOGEN RK, produced by Dai-Ichi Kogyo Seiyaku Co., Ltd.) is added and the stainless steel flask is closed hermetically. While continuing agitation with a magnetic seal, the mixture is heated to 73° C. and is held at 73° C. for 8 hours. Then, toner particles (J) are obtained by performing cooling at a cooling rate of 10° C./min, filtration, full washing with ion exchange water, and drying.

An external additive treatment is applied to the toner particles (J) in a similar manner to that in Example 1 to obtain toner J. Then, evaluations similar to those of Example 1 are conducted by using the toner J as a developer.

Results are shown in Table 1 together with the properties of the toner J.

TABLE 1

| | | | | | | | Evaluation | | |
|---|---|---|---|---|---|---|---|---|---|
| | Number average particle diameter (μm) | Average circularity degree | Melting temperature of releasing agent (° C.) | Fusing process temperature (° C.) | M ratio in toner (number %) | L ratio in toner (number %) | Tone reproduction limit area ratio (%) | Number of scattering toner (particles/cm$^3$) | Dencity unevenness |
| Example 1 | 5.11 | 0.961 | 77 | 70 | 9 | 2 | A | A | A |
| Example 2 | 5.55 | 0.964 | 83 | 73 | 9 | 4 | A | B | A |
| Example 3 | 6.34 | 0.958 | 89 | 80 | 6 | 2 | A | A | B |
| Example 4 | 5.08 | 0.969 | 83 | 77 | 14 | 3 | C | A | C |
| Example 5 | 5.98 | 0.971 | 72 | 66 | 12 | 4 | C | B | C |
| Example 6 | 4.88 | 0.955 | 103 | 97 | 7 | 3 | A | A | B |
| Example 7 | 5.45 | 0.962 | 89 | 84 | 6 | 4 | A | B | B |
| Comparative Example 1 | 5.89 | 0.954 | 103 | 83 | 2 | 4 | D | B | D |
| Comparative Example 2 | 5.21 | 0.974 | 72 | 92 | 18 | 4 | D | B | A |
| Comparative Example 3 | 6.54 | 0.963 | 72 | 73 | 10 | 15 | B | D | A |

As shown in Table 1, when the toners of Examples are used in which optimization is made so that particle diameter distribution/circularity distribution will fall within the above-mentioned ranges, it is possible to achieve low-temperature fixation. In addition, the tone/density reproducibility is also satisfactory and there is almost no problem with regard to the in-machine stain.

On the other hand, in Comparative Examples where toners whose particle diameter distribution/circularity distribution fail to satisfy the above-mentioned ranges, some problems occur in the property evaluations.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for developing an electrostatic charge image comprising a binder resin, a colorant and a releasing agent, wherein a content ratio of toner particles having a number particle diameter of 5.0 μm or more and less than 7.0 μm and a circularity degree of 0.980 or more is in a range of from 10 number % to 12 number % based on the total number of toner particles, a content ratio of toner particles having a number particle diameter of 7.5 μm or more and less than 15 μm and a circularity degree of 0.900 or more and less than 0.940 is 5 number % or less, based on the total number of toner particles, a number average particle diameter of the toner particles is in a range of from 3 μm to to 8 μm, an average circularity degree of the toner particles is in a range of from 0.940 to 0.980, and the binder resin comprises:

a crystalline polyester resin; and a non-crystalline polyester resin that contains a resin of a high molecular weight component and a resin of a low molecular weight component.

2. The toner for developing an electrostatic charge image of claim 1, wherein an acid-derived component of the crystalline polyester resin contains an aliphatic dicarboxylic acid.

3. The toner for developing an electrostatic charge image of claim 2, wherein the aliphatic dicarboxylic acid is a straight chain carboxylic acid.

4. The toner for developing an electrostatic charge image of claim 1, wherein an alcohol-derived component of the crystalline polyester resin comprises an aliphatic diol-derived constituent, and a content of the aliphatic diol-derived constituent component in the alcohol-Derived component included in the crystalline polyester resin is about 80% by constituent mole or more.

5. The toner for developing an electrostatic charge image of claim 1, wherein the crystalline polyester resin is an aliphatic crystalline polyester resin.

6. The toner for developing an electrostatic charge image of claim 5, wherein a constituent ratio of an aliphatic polymerizable monomer that constitutes the aliphatic crystalline polyester resin is about 60 mol % or more.

7. The toner for developing an electrostatic charge image of claim 5, wherein the aliphatic crystalline polyester resin is an aliphatic crystalline polyester resin which is obtained by reacting a dicarboxylic acid having 10 to 12 carbon atoms with a diol having 4 to 9 carbon atoms.

8. The toner for developing an electrostatic charge image of claim 1, wherein a weight average molecular weight Mw of the crystalline polyester resin is in a range of from about 6,000 to about 35,000.

9. The toner for developing an electrostatic charge image claim 1, wherein a melting temperature Tm of the crystalline polyester resin is in a range of from about 60° C. to about 120° C.

10. The toner for developing an electrostatic charge image claim 1, wherein a content of the crystalline polyester resin in the toner is in a range of from about 1% by weight to about 40% by weight.

11. The toner for developing an electrostatic charge image of claim 1, wherein a weight average molecular weight Mw of the resin of the high molecular weight component is in a range of from about 30,000 to about 200,000.

12. The toner for developing an electrostatic charge image claim 1, wherein a weight average molecular weight Mw of the resin of the low molecular weight component is from about 8,000 to about 25,000.

13. The toner for developing an electrostatic charge image claim 1, wherein a mixing ratio P/Q is in a range of from about 10/90 to about 70/30 in which the weight of the high molecular weight component is indicated by P and the weight of the low molecular weight component is indicated by Q.

14. An electrostatic charge image developer comprising a toner, wherein the toner is the toner for developing an electrostatic charge image of claim 1.

15. The toner for developing an electrostatic charge image of claim 1, wherein the content ratio of toner particles having a number particle diameter of 7.5 μm or more and less than 15 μm and a circularity degree of 0.900 or more and less than 0.940 is about 3 number % based on the total number of toner particles.

16. The toner for developing an electrostatic charge image of claim 1, wherein a content ratio of toner particles having a number particle diameter of 7.5 μm or more and less than 15 μm and a circularity degree of 0.900 or more and less than 0.940 is about 0 number % based on the total number of toner particles.

17. A toner for developing an electrostatic charge image comprising a binder resin, a colorant and a releasing agent, wherein a content ratio of toner particles having a number particle diameter of 5.0 μm or more and less than 7.0 μm and a circularity degree of 0.980 or more is in a range of from 10 number % to 12 number % based on the total number of toner particles, a content ratio of toner particles having a number particle diameter of 7.5 μm or more and less than 15 μm and a circularity degree of 0.900 or more and less than 0.940 is about 3 number % or less based on the total number of toner particles, the binder resin comprises:

a crystalline polyester resin; and a non-crystalline polyester resin that contains a resin of a high molecular weight component and a resin of a low molecular weight component.

18. The toner for developing an electrostatic charge image of claim 17, wherein a content ratio of toner particles having a number particle diameter of 7.5 μm or more and less than 15 μm and a circularity degree of 0.900 or more and less than 0.940 is about 0 number % based on the total number of toner particles.

* * * * *